US012408728B2

(12) United States Patent
Decker

(10) Patent No.: US 12,408,728 B2
(45) Date of Patent: Sep. 9, 2025

(54) ANTI-FATIGUE SHOE APPARATUS

(71) Applicant: DECKER BRANCH LLC, Baton Rouge, LA (US)

(72) Inventor: Edward Jerome Decker, Baton Rouge, LA (US)

(73) Assignee: DECKER BRANCH LLC, Baton Rouge, LA (US)

( * ) Notice: Subject to any disclaimer, the term of this patent is extended or adjusted under 35 U.S.C. 154(b) by 32 days.

(21) Appl. No.: 18/409,094

(22) Filed: Jan. 10, 2024

(65) Prior Publication Data

US 2024/0292927 A1 Sep. 5, 2024

Related U.S. Application Data

(60) Provisional application No. 63/449,661, filed on Mar. 3, 2023.

(51) Int. Cl.

| | |
|---|---|
| ***A43B 7/1405*** | (2022.01) |
| ***A43B 7/144*** | (2022.01) |
| ***A43B 7/148*** | (2022.01) |
| ***A43B 13/12*** | (2006.01) |
| ***A43B 13/18*** | (2006.01) |

(52) U.S. Cl.

CPC ..... *A43B 13/181* (2013.01); *A43B 7/1405* (2013.01); *A43B 7/144* (2013.01); *A43B 7/148* (2013.01); *A43B 13/127* (2013.01)

(58) Field of Classification Search

CPC ... A43B 13/181; A43B 13/186; A43B 13/188; A43B 7/148; A43B 7/1405; A43B 7/1425; A43B 7/1485; A43B 7/144; A43B 7/142

USPC ..... 36/25 R, 28

See application file for complete search history.

(56) References Cited

U.S. PATENT DOCUMENTS

| | | | | |
|---|---|---|---|---|
| 4,930,232 | A | 6/1990 | Engle | |
| 6,061,929 | A * | 5/2000 | Ritter | A43B 3/122 36/31 |
| 6,453,578 | B1 * | 9/2002 | Yung | A43B 7/22 36/43 |
| 6,516,541 | B2 | 2/2003 | Cagner | |
| 7,464,490 | B2 | 12/2008 | Lebo | |
| 8,813,391 | B1 * | 8/2014 | Khaitan | A43B 17/006 36/28 |
| 9,565,895 | B2 | 2/2017 | Byrne | |

(Continued)

FOREIGN PATENT DOCUMENTS

WO 2018192262 A1 10/2018

*Primary Examiner* — Marie D Bays

(74) *Attorney, Agent, or Firm* — Lemler IP, LLC; Thomas E. Lemler

(57) ABSTRACT

An anti-fatigue shoe apparatus is presented that is designed to reduce foot fatigue and discomfort. The anti-fatigue shoe apparatus makes use of novel combinations of insole, midsole, outsole, and comfort material configurations and designs to provide comfort, support, and flexibility within work footwear. The anti-fatigue shoe apparatus includes a raised arch support piece that cradles the foot's natural arch, reducing torque and improving stability. Toe and heel comfort zones made of cushioning materials provide targeted support and pressure relief. In some embodiments an injection system for providing a liquid comfort material injected into the toe and heel zones through canals in the outsole are presented for customized cushioning. The invention comes in various material combinations.

9 Claims, 20 Drawing Sheets

(56) References Cited

U.S. PATENT DOCUMENTS

| | | | | |
|---|---|---|---|---|
| 10,772,381 | B2 | 9/2020 | Schwartz | |
| 2004/0118017 | A1* | 6/2004 | Dalton | A43B 17/08 36/3 R |
| 2005/0268490 | A1* | 12/2005 | Foxen | A43B 7/1445 36/28 |
| 2006/0277788 | A1* | 12/2006 | Fujii | A43B 17/02 36/28 |
| 2007/0128403 | A1* | 6/2007 | Yang | A43B 7/144 428/137 |
| 2007/0151124 | A1* | 7/2007 | Chan | A43B 7/1445 36/35 R |
| 2012/0047768 | A1 | 3/2012 | Brave | |
| 2013/0047462 | A1* | 2/2013 | Chang | A43B 7/223 36/43 |
| 2014/0075778 | A1* | 3/2014 | Bruce | A43B 7/1445 36/29 |
| 2014/0075779 | A1* | 3/2014 | Bruce | A43B 13/181 36/29 |
| 2016/0316853 | A1* | 11/2016 | Iuchi | A43B 7/087 |
| 2018/0153253 | A1* | 6/2018 | Ward | A43B 13/186 |
| 2021/0000218 | A1* | 1/2021 | Ophir | A43B 7/144 |
| 2021/0204655 | A1* | 7/2021 | Grimes | A43B 17/16 |
| 2022/0053880 | A1* | 2/2022 | Taylor | A43B 13/188 |
| 2022/0095739 | A1* | 3/2022 | Brackenbury | A43B 7/142 |

* cited by examiner

ANTI-FATIGUE SHOE APPARATUS

CROSS REFERENCE TO RELATED APPLICATIONS

This application claims priority to and the benefit of U.S. Provisional Patent Application No. 63/449,661, filed Mar. 3, 2023, which is incorporated herein by reference.

BACKGROUND OF THE INVENTION

The present invention pertains to an anti-fatigue shoe apparatus for long term usage and to improving the comfort of a worker who is required to stand for multiple long hours per day. The present invention further pertains to an apparatus that combines comfort and strength to a worker's foot. The apparatus is designed without the use of hard and overly sturdy materials that create extremely limited flexibility of shoes and work boots. The present invention utilizes novel combinations of insole, midsole, and outsole designs that provide comfort and flexibility within shoes for workers, so that comfort and support are achieved when long term static pressure on or long hours walking in work footwear are required.

DESCRIPTION OF THE RELATED ART

Most work footwear soles are made from hard and sturdy materials due to the need for protection and durability, such materials provide very little flexibility. Work footwear that provides increased flexibility and adequate support to workers who are required to stand for multiple hours per day and/or walk several miles per day, over long periods of time, are important for the long-term health of workers. Having access to footwear that provides workers' feet with the ability to rest in the natural position while in a standing position while also providing enough support for adequate movement is increasingly necessary.

Work footwear has been available in the market for quite some time. Existing footwear is available in a multitude of various shapes, sizes, harnesses, usage purposes, and stiffnesses, all of which have the basic utility of providing comfort and support to users' feet. There have also been many variations of footwear designed for workers with the same basic utility.

The vital nature of providing proper support and comfort to workers' feet will continue to remain significant. These basic requirements are critical for all humans to preserve health and reduce the risk of various injuries. Perhaps the greatest problem that exists with work footwear is that currently available products on the market provide little flexibility and/or are designed solely for fashion. Additionally, currently available work footwear is not specifically designed for workers that are required to stand for long periods of the day nor for workers that are required to walk multiple miles per day. It is the goal of the present invention to use novel combinations of insole, midsole, outsole, and comfort material designs to provide comfort, support, and flexibility within work footwear, such that comfort and support are achieved when long term static pressure within or long hours of walking in work footwear are required.

U.S. Pat. No. 10,772,381 B2 discloses a shoe insole that includes a semi-rigid shell that includes a notch located on the outward side of the wearer's foot to accommodate pronation of the foot during use for providing a wearer with extended comfort. Additionally, the semi-rigid shell includes an extended side portion located opposite of the notch side on an inner side of the wearer's foot. The semi-rigid shell is shorter in length than the length of a shoe sole and slightly shorter in width and may be combined with an insole comfort cover to provide cushion between the wearer's foot and the semi-rigid shell.

U.S. Pat. No. 6,516,541 B2 discloses a toddler's and children's shoe meeting a parent's need for fashionable decoration of the toddler, while simultaneously allowing that child freedom and comfort of pedal movement, while avoiding repetitive stress injury to the foot. This reference discloses a shoe with a flexible outersole, an insole, an upper formed from a flat Thermo Plastic Rubber blank, and a toe cap fabricated in the blank via a teacup crease special-use sewing machine. The blank or preform subsequently affixed to a last and joined by a second special purpose sewing machine, or disc feed overseaming machine, to a non-woven fabric midsole or insole which, substantially completes the upper without use of an insole board. The outersole of the shoe is unitary in construction and equipped with a unique pattern of intersecting grooves, as well as, an external bridge or instep support in lieu of an inner steel shank.

U.S. Pat. No. 4,930,232 A discloses a multilayer laminate for use as a sole of a fashion or dress shoe, wherein the shoe construction includes a combination of rigid support materials and polymeric foam materials of varying Shore hardness values permanently attached atop a conventional outer sole. The specific structural configuration of the material enhances the durability of the shoe and improves the comfort it provides for its wearer when engaged in walking, strolling, or other foot-utilizing activity.

U.S. Pat. No. 7,464,490 B2 discloses a multilayered sole having an insole, a midsole, and an outsole, where the insole extends from a toe area to a heel area that has a rigid member and a flexible member for enhancing flexibility. The midsole extends from the toe area to the heel area and has a cushioning material and a structural material for enhancing comfort.

U.S. Pat. No. 9,565,895 B2 discloses an article of footwear that has a molded outsole which contains a resilient midsole located in the cavity of the outsole, the midsole has sections of different hardness in the heel area and the forefoot area, and a footbed cover which has a stretch material layer affixed to the outsole and provides a stretch zone. The stretch zone and the footbed cover work in conjunction with the midsole to absorb shock upon heel strike or other compression of the midsole to increase comfort.

U.S. Patent Application Publication 2012/0047768 A1 discloses a silicone gel insole/midsole for numerous types of footwear that is layered and bonded between the upper of a shoe and an extra-depth outsole. The silicone insole/midsole covers the entire top surface of the relatively rigid outsole of the footwear. The insole/midsole uses silicone gel material in functional relation with an article of footwear in order to enhance fit, support, comfort, cushioning and to mimic the energy dissipation properties of human soft tissue and structure.

WIPO Patent Publication No. WO 2018/192262 A1 discloses an insole or a sole having a recess in the shape of a figure-of-eight and a soft cushioning layer covering the recess in contact with the soft cushioning located on the top surface of an insole body. The figure-of-eight-shaped recess includes a rear recess, a front recess corresponding to the position of a metatarsal bone, and a middle recess communicating with the rear recess and the front recess. The front end of the front recess inclines to the inner side of the insole body and the bottom surface of the front recess rises from the edge of the recess to the center of the recess to form a raised arc surface.

All aforementioned patents and publications are incorporated herein by reference.

While these devices may be suitable for the particular purpose employed, they would not be as suitable, or suitable at all, for the purposes of the present invention as disclosed hereafter.

While the prior art discloses various devices and apparatuses for providing comfort to users of footwear, the present invention implements the use of novel combinations of insole, midsole, outsole, and comfort material configurations and designs to provide comfort, support, and flexibility within work footwear. This is advantageous because these novel configurations and designs can accommodate the comfort and support needs of workers that are required to stand for long periods of the workday, which results in significant static pressure on insoles, midsoles, and outsoles. Additionally advantageous aspects of the present invention also accommodate the comfort and support needs of workers that are required to walk several miles per day, which requires additional flexibility. Thus, the present invention ensures that workers with these needs do not experience discomfort while also allowing for workers' feet to rest in the natural position by conforming with the natural shape of the workers' feet.

SUMMARY OF THE INVENTION

It is one prospect of the present invention to provide a novel apparatus that combines comfort and strength to a worker's foot, the apparatus is designed for long-term usage by users who spend long hours in a standing position without the use of hard and overly sturdy materials that create extremely limited flexibility of shoes and work boots, the present invention utilizes a novel combination of insole, midsole, and outsole designs to provide comfort to users so that comfort and support are achieved when static pressure in the users' shoes and work boots are required.

The following presents a simplified summary of the present disclosure in a simplified form as a prelude to the more detailed description that is presented herein.

Therefore, in accordance with a preferred embodiment of the present invention, there is provided an anti-fatigue shoe apparatus. The anti-fatigue shoe apparatus has an outsole that has a top outsole surface that is opposite a bottom outsole surface. The bottom outsole surface is adapted to grip the ground. The anti-fatigue shoe apparatus has a midsole that is adapted to reduce torque. The midsole has a top midsole surface that is opposite a bottom midsole surface. In accordance with the present invention, a midsole arch cavity is centrally formed within the bottom midsole surface of the midsole and is located between a midsole toe section the is oriented laterally opposite of a midsole heel section. A raised arch shaped support piece is oriented within and adhered to the bottom midsole surface of the midsole arch cavity. The raised arch shaped support piece is adapted to the natural curvature of a human foot. The anti-fatigue shoe apparatus includes a midsole arch liner that is adhered to and located within the bottom midsole surface of the midsole arch cavity. A midsole toe cavity is formed in a substantially elliptical shape and located within the bottom midsole surface of the midsole toe section. The midsole toe cavity is lined with a midsole toe liner. A midsole heel cavity is formed in a substantially oval shape and is located within the bottom midsole surface of the midsole heel section. The midsole heel cavity is also lined with a midsole heel liner. In accordance with the present invention, a toe comfort zone is located within the midsole toe cavity and a heel comfort zone is located within the midsole heel cavity. The anti-fatigue shoe apparatus includes an insole that has a top insole surface oriented opposite a bottom insole surface. The bottom insole surface is adhered to the top midsole surface and the bottom midsole surface is adhered to the top outsole surface.

In one embodiment, the outsole of the anti-fatigue shoe apparatus is made out of a material that is either rubber, leather, polyurethane, or a combination of those materials.

In another embodiment, the midsole of the anti-fatigue shoe apparatus is made out of a material that is either ethyl vinyl acetate, plastic, rubber, polyurethane, or a combination of those materials.

In yet another embodiment, the raised arch shaped support piece of the anti-fatigue shoe apparatus is made out of a material that is either ethyl vinyl acetate, plastic, rubber, polyurethane foam, polyurethane gel, memory foam, vinyl, cork, plastic, or a combination of those materials.

In one embodiment, the midsole arch liner of the anti-fatigue shoe apparatus is made out of a material that is either rubber, leather, plastic, polyurethane, or a combination of those materials.

In another embodiment, the midsole toe liner and the midsole heel liner of the anti-fatigue shoe apparatus are made out of a material that is either rubber, leather, plastic, polyurethane, or a combination of those materials.

In yet another embodiment, the midsole toe cavity and the midsole heel cavity are reinforced with a spray on material that consists of polyurethane, polyamide, polyacrylonitrile, or a combination of those materials.

In one embodiment, the toe comfort zone and the heel comfort zone of the anti-fatigue shoe apparatus are made out of a material that is either rubber, polyurethane foam, polyurethane gel, memory foam, vinyl, cork, plastic, or a combination of those materials.

In another embodiment, the anti-fatigue shoe apparatus further includes a tubular injection canal aperture that is located in the outsole. The tubular injection canal aperture leads to an outsole central injection canal. In accordance with the present embodiment, a heel comfort zone canal rises vertically from the outsole central injection canal and terminates within the midsole heel cavity through a midsole heel cavity injection aperture. A toe comfort zone canal also rises vertically from the outsole central injection canal and terminates within the midsole toe cavity through a midsole toe cavity injection aperture. In accordance with this embodiment of the anti-fatigue shoe apparatus, the outsole central injection canal, the heel comfort zone canal, and the toe comfort zone canal are adapted to receive and retain the material that the toe comfort zone and the heel comfort zone are made out of in liquid form.

In another preferred embodiment of the invention, an anti-fatigue shoe apparatus is presented. The anti-fatigue shoe apparatus includes an outsole that has a top outsole surface that is oriented opposite a bottom outsole surface. The bottom outsole surface is designed to grip the ground. The anti-fatigue shoe apparatus further includes a midsole that is designed to reduce torque. The midsole has a top midsole surface that is oriented opposite a bottom midsole surface. In accordance with the present invention, a midsole arch cavity is formed centrally within the bottom midsole surface of the midsole and is located between a midsole toe section that is oriented laterally opposite a midsole heel section. A raised arch shaped support piece is located within and adhered to the bottom midsole surface of the midsole arch cavity. The raised arch shaped support piece is designed to fit the natural curvature of a human foot. The anti-fatigue shoe apparatus includes a midsole arch liner adhered to and located within the bottom midsole surface of the midsole arch cavity. A midsole toe aperture is formed in a substantially elliptical shape and oriented though the midsole toe section and a midsole heel aperture is formed in a substantially oval shape and oriented through the midsole heel section. In accordance with the present invention, a toe comfort zone is located within the midsole toe aperture and surrounded by the top midsole surface. Furthermore, a top surface of the toe comfort zone is lined with a toe comfort zone fabric that is designed for direct contact with a ball of the human foot. A heel comfort zone is located within the midsole heel aperture and is also surrounded by the top midsole surface. A top surface of the heel comfort zone is lined with a heel comfort zone fabric that is designed for direct contact with a heel of the human foot and the bottom midsole surface is adhered to the top outsole surface.

In one embodiment, the anti-fatigue shoe apparatus further includes an insole having a top insole surface oriented opposite a bottom insole surface. In such embodiment, the bottom insole surface is adhered to the top midsole surface.

In another embodiment, the outsole is constructed from at least one of or a combination of materials that include rubber, leather, and polyurethane.

In yet another embodiment, the midsole is constructed from at least one of or a combination of materials that include ethyl vinyl acetate, plastic, rubber, and polyurethane.

In one embodiment, the raised arch shaped support piece is constructed from at least one of or a combination of materials that include ethyl vinyl acetate, plastic, rubber, polyurethane foam, polyurethane gel, memory foam, vinyl, cork, and plastic.

In another embodiment, the midsole arch liner is constructed from at least one of or a combination of materials that include rubber, leather, plastic, and polyurethane.

In yet another embodiment, the toe comfort zone fabric and the heel comfort zone fabric are constructed from at least one of or a combination of materials that include petroleum, polyurethane, and leather.

In one embodiment, the toe comfort zone and the heel comfort zone are constructed from at least one of or a combination of materials that include rubber, polyurethane foam, polyurethane gel, memory foam, vinyl, cork, and plastic.

In another related embodiment, the anti-fatigue shoe apparatus further includes a tubular injection canal aperture located in the outsole. The tubular injection canal aperture leads to an outsole central injection canal, where a heel comfort zone canal rises vertically from the outsole central injection canal and terminates within the midsole heel aperture through a midsole heel injection aperture. In accordance with such embodiment of the invention, a toe comfort zone canal rises vertically from the outsole central injection canal and terminates within the midsole toe aperture through a midsole toe injection aperture. The outsole central injection canal, the heel comfort zone canal, and the toe comfort zone canal are designed to receive and retain the material of the toe comfort zone and the heal comfort zone in liquid form.

In accordance with yet another preferred embodiment of the invention, an anti-fatigue shoe apparatus is presented. The anti-fatigue shoe apparatus includes an outsole that has a top outsole surface oriented opposite a bottom outsole surface. The bottom outsole surface is designed to grip the ground and a midsole is designed to reduce torque. The midsole has a top midsole surface oriented opposite a bottom midsole surface. A midsole arch cavity is formed centrally within the bottom midsole surface of the midsole and located between a midsole toe section that is oriented laterally opposite a midsole heel section. In accordance with the present invention, the anti-fatigue shoe apparatus includes a raised arch shaped support piece located within and adhered to the bottom midsole surface of the midsole arch cavity, and the raised arch shaped support piece is designed to receive the shape of the natural curvature of the arch of a human foot. Furthermore, a midsole toe cavity is formed in a substantially elliptical shape and located within the bottom midsole surface of the midsole toe section. A midsole heel cavity is formed in a substantially oval shape and located within the bottom midsole surface of the midsole heel section. The anti-fatigue shoe apparatus includes an extruding toe comfort zone that is adhered to and located within the midsole toe cavity and an extruding heel comfort zone that is adhered to and located within the midsole heel cavity. In accordance with the present invention, the anti-fatigue shoe apparatus also includes an outsole toe cavity that is formed in a substantially elliptical shape and is located within the top outsole surface. The outsole toe cavity is designed to receive a bottom surface of the extruding toe comfort zone and is aligned with the midsole toe section. An outsole arch cavity is formed centrally within the top outsole surface of the outsole, and the outsole arch cavity is designed to receive and retain the raised arch shaped support. In accordance with the present invention, the anti-fatigue shoe apparatus also includes an outsole heel cavity that is formed in a substantially oval shape and oriented within the top outsole surface. The outsole heel cavity is designed to receive a bottom surface of the extruding heel comfort zone and is aligned with the midsole heel section. The bottom midsole surface is adhered to the top outsole surface.

In one embodiment, the anti-fatigue shoe apparatus further includes an insole that has a top insole surface oriented opposite a bottom insole surface and the bottom insole surface is adhered to the top midsole surface.

In another embodiment, the outsole is constructed from at least one of or a combination of materials that include rubber, leather, and polyurethane.

In yet another embodiment, the midsole is constructed from at least one of or a combination of materials that include ethyl vinyl acetate, plastic, rubber, and polyurethane.

In one embodiment, the raised arch shaped support piece is constructed from at least one of or a combination of materials that include ethyl vinyl acetate, plastic, rubber, polyurethane foam, polyurethane gel, memory foam, vinyl, cork, and plastic.

In another embodiment, the midsole toe cavity, the midsole heel cavity, the outsole toe cavity, and the outsole heel cavity are reinforced with a spray on material which is made of at least one of or a combination of materials that include polyurethane, polyamide, and polyacrylonitrile.

In yet another embodiment, the extruding toe comfort zone and the extruding heel comfort zone are constructed from at least one of or a combination of materials that include rubber, polyurethane foam, polyurethane gel, memory foam, vinyl, cork, and plastic.

In another related embodiment, the anti-fatigue shoe apparatus further includes a tubular injection canal aperture located in the outsole. The tubular injection canal aperture opens to a central injection canal. An outsole heel injection canal rises vertically from the central injection canal and terminates within the outsole heel cavity through a heel cavity injection aperture. In accordance with such embodiment of the invention, an outsole toe injection canal rises vertically from the central injection canal and terminates within the outsole toe cavity through an outsole toe cavity injection aperture. The central injection canal is designed to be substantially U-shaped and located below the outsole arch cavity. The outsole heel injection canal, the central injection canal, and the outsole toe injection canal is designed to receive and retain the material of the extruding toe comfort zone and the extruding heel comfort zone in liquid form.

In accordance with an additional preferred embodiment of the present invention, an anti-fatigue shoe apparatus is presented. The anti-fatigue shoe apparatus includes an outsole that has a top outsole surface oriented opposite a bottom outsole surface. The bottom outsole surface is designed to grip the ground. The anti-fatigue shoe apparatus also includes a midsole that has a top midsole surface oriented opposite a bottom midsole surface. The top midsole surface includes a midsole toe cavity that is oriented laterally opposite from a midsole heel cavity. The midsole toe cavity is formed in a substantially elliptical shape and located within the top midsole surface, where the midsole heel cavity is formed in a substantially oval shape and is located within the top midsole surface. In accordance with the present invention, the anti-fatigue shoe apparatus includes an insole that has a top insole surface oriented opposite a bottom insole surface. An insole arch cavity is formed centrally within the bottom insole surface and the insole arch cavity is located between an insole toe section of the bottom insole surface which is oriented laterally opposite from an insole heel section of the bottom insole surface. The anti-fatigue shoe apparatus includes a raised arch shaped support piece located within and adhered to the bottom insole surface of the insole arch cavity. A midsole arch cavity is centrally formed within the top midsole surface and the midsole arch cavity is located between the midsole toe cavity and the midsole heel cavity. The midsole arch cavity is formed to retain the raised arch shaped support piece. The raised arch shaped support piece is designed to receive the shape of a natural curvature of the arch of a human foot. In accordance with the present invention, an insole toe cavity is formed in a substantially elliptical shape and located within the bottom insole surface of the insole toe section. Included is an insole heel cavity that is formed in a substantially oval shape and located within the bottom insole surface of the insole heel section. An extruding toe comfort zone is adhered to and located within the insole toe cavity and an extruding heel comfort zone is adhered to and located within the insole heel cavity. The midsole toe cavity is designed to receive a bottom surface of the extruding toe comfort zone, and the midsole heel cavity is designed to receive a bottom surface of the extruding heel comfort zone. The bottom insole surface is adhered to the bottom midsole surface and the bottom midsole surface is adhered to the top outsole surface.

In one embodiment, the outsole is constructed from at least one of or a combination of materials that include rubber, leather, and polyurethane.

In another embodiment, the midsole is constructed from at least one of or a combination of materials that include ethyl vinyl acetate, plastic, rubber, and polyurethane.

In yet another embodiment, the insole is constructed from at least one of or a combination of materials that include ethyl vinyl acetate, plastic, rubber, and polyurethane.

In one embodiment, the raised arch shaped support piece is constructed from at least one of or a combination of materials that include ethyl vinyl acetate, plastic, rubber, polyurethane foam, polyurethane gel, memory foam, vinyl, cork, and plastic.

In another embodiment, the insole toe cavity, the insole heel cavity, the midsole toe cavity, and the midsole heel cavity are reinforced with a spray on material which is made of at least one of or a combination of materials that include polyurethane, polyamide, and polyacrylonitrile.

In yet another embodiment, the extruding toe comfort zone and the extruding heel comfort zone are constructed from at least one of or a combination of materials that include rubber, polyurethane foam, polyurethane gel, memory foam, vinyl, cork, and plastic.

In another related embodiment, the anti-fatigue shoe apparatus further includes a tubular injection canal aperture located in the outsole. The tubular injection canal aperture leads to an outsole central injection canal and a heel comfort zone canal rises vertically from the outsole central injection canal that terminates within the midsole heel cavity through a midsole heel cavity injection aperture. A toe comfort zone canal rises vertically from the outsole central injection canal and terminates within the midsole toe cavity through a midsole toe cavity injection aperture. In accordance with such embodiment, the outsole central injection canal, the heel comfort zone canal, and the toe comfort zone canal are designed to receive and retain the material of the extruding toe comfort zone and the extruding heal comfort zone in liquid form.

BRIEF DESCRIPTION OF THE DRAWINGS

Illustrative embodiments of the present invention are described herein with reference to the accompanying drawings, in which.

DETAILED DESCRIPTION

Figure 1:
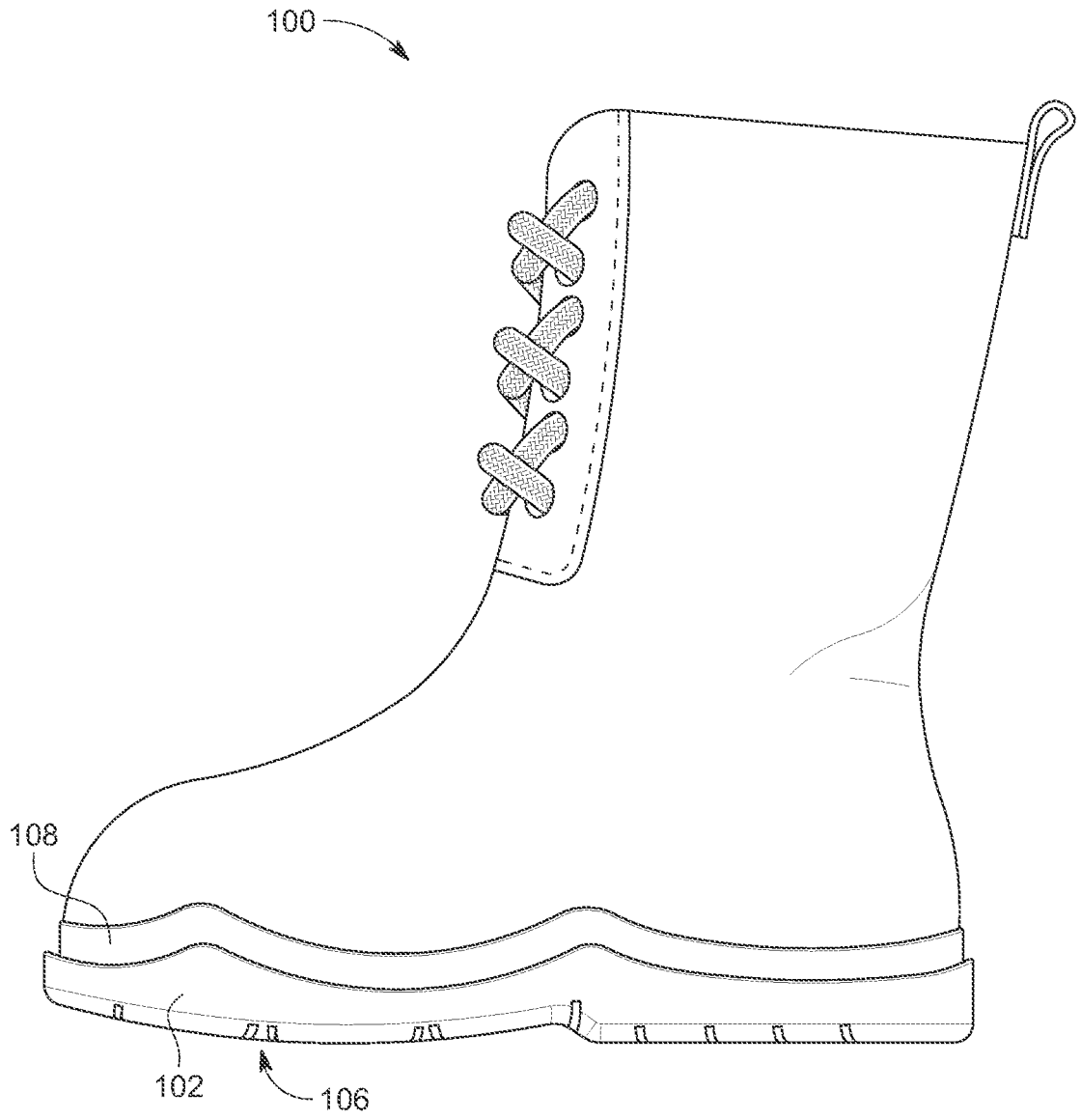
FIG. 1 is a right side elevation view of an anti-fatigue shoe apparatus within a work boot, according to a preferred embodiment of the present invention.

For a further understanding of the nature and function of the embodiments, reference should be made to the following detailed description. Detailed descriptions of the embodiments are provided herein, as well as, the best mode of carrying out and employing the present invention. It will be readily appreciated that the embodiments are well adapted to carry out and obtain the ends and features mentioned as well as those inherent herein. It is to be understood, however, that the present invention may be embodied in various forms. Therefore, persons of ordinary skill in the art will realize that the following disclosure is illustrative only and not in any way limiting, as the specific details disclosed herein provide a basis for the claims and a representative basis for teaching to employ the present invention in virtually any appropriately detailed system, structure, or manner. It should be understood that the devices, materials, methods, procedures, and techniques described herein are presently representative of various embodiments. Other embodiments of the disclosure will readily suggest themselves to such skilled persons having the benefit of this disclosure.

Referring initially to FIGS. 1-4, the basic constructional details and principles of operation of an anti-fatigue shoe apparatus 100 according to a preferred embodiment of the present invention will be discussed.

FIGS. 1-4 illustrate a preferred embodiment of the anti-fatigue shoe apparatus 100 that includes an outsole 102 that has a top outsole surface 104 that is opposite a bottom outsole surface 106. The bottom outsole surface 106 is adapted to grip the ground. Although the present invention provides for increased flexibility of work footwear, the anti-fatigue shoe apparatus 100 has a midsole 108 that is adapted to reduce torque. The midsole 108 has a top midsole surface 110 that is opposite a bottom midsole surface 112.

Figure 2:
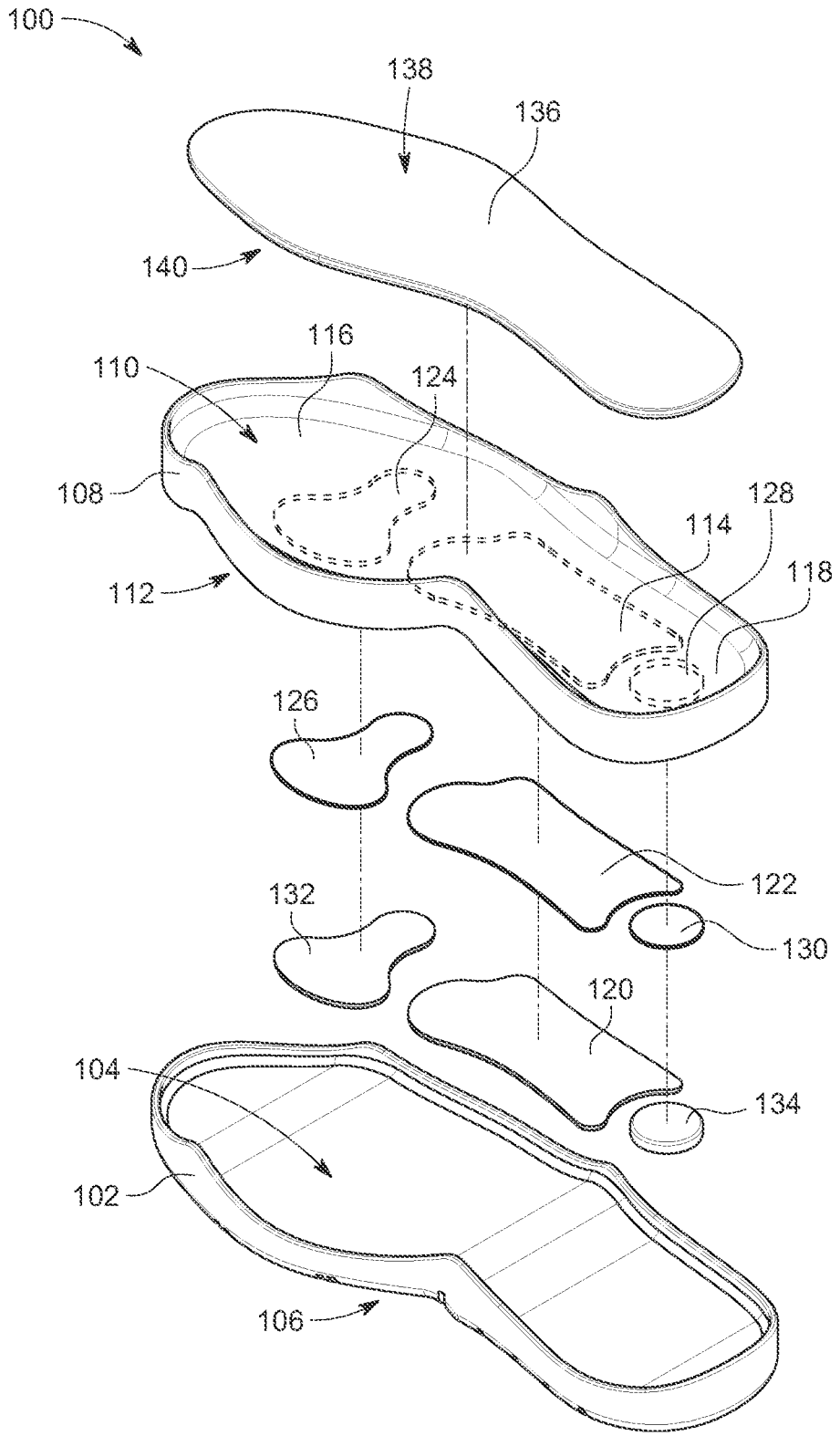
FIG. 2 is a top, rear, left side exploded perspective view of an anti-fatigue shoe apparatus, according to a preferred embodiment of the present invention.
Figure 3:
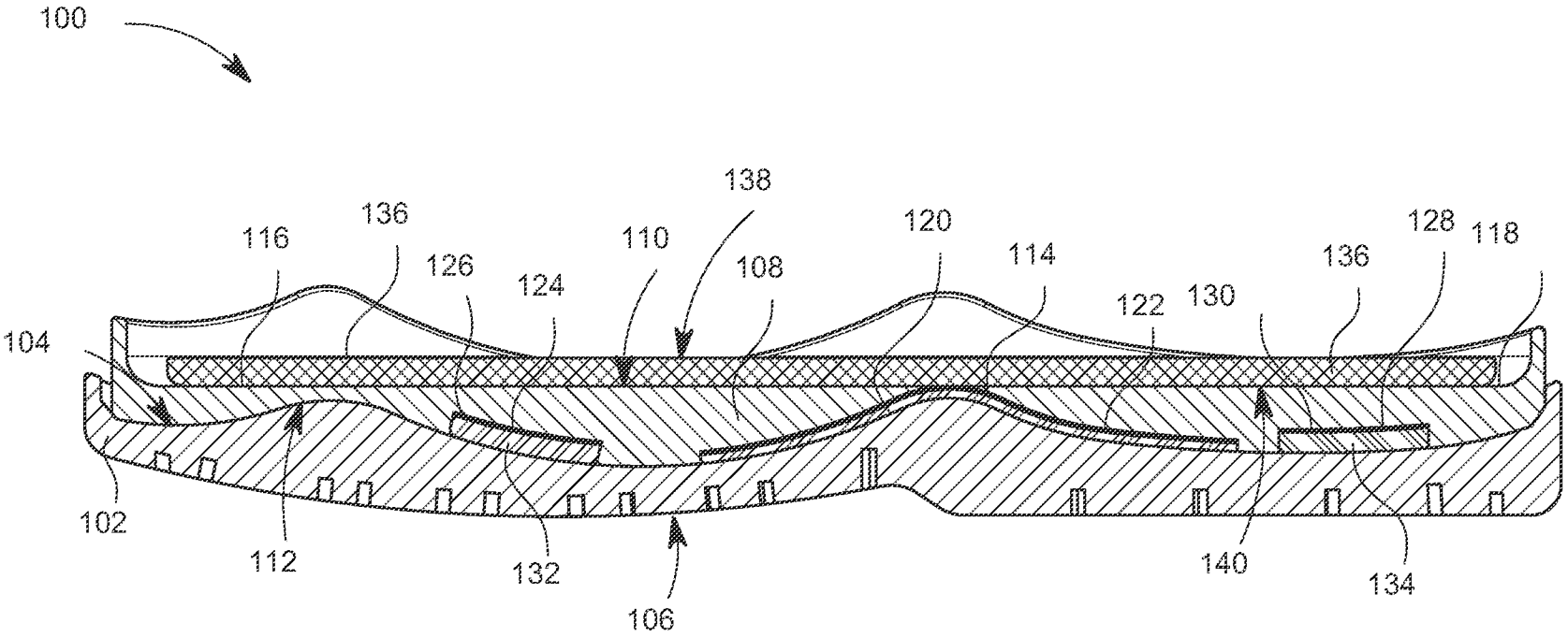
FIG. 3 is a right side cross-sectional elevation view thereof, according to preferred embodiments.

In accordance with the present invention, as illustrated in FIGS. 2 and 3, a midsole arch cavity 114 is centrally formed within the bottom midsole surface 112 of the midsole 108 and is located between a midsole toe section 116 that is oriented laterally opposite of a midsole heel section 118. A raised arch shaped support piece 120 is oriented within and adhered to the bottom midsole surface 112 of the midsole arch cavity 114. The raised arch shaped support piece 120 is adapted to the natural curvature of a human foot. The anti-fatigue shoe apparatus 100 includes a midsole arch liner 122 that is adhered to and located within the bottom midsole surface 112 of the midsole arch cavity 114, as shown in FIG. 2, the midsole arch liner 122 is located between the midsole bottom surface 112 and the raised arch shaped support piece 120. A midsole toe cavity 124 is formed in a substantially elliptical shape and located within the bottom midsole surface 112 of the midsole toe section 116. The midsole toe cavity 124 is lined with a midsole toe liner 126. A midsole heel cavity 128 is formed in a substantially oval shape and is located within the bottom midsole surface 112 of the midsole heel section 118. The midsole heel cavity 128 is also lined with a midsole heel liner 130.

In accordance with the present invention, as illustrated in FIGS. 2 and 3, a toe comfort zone 132 is located within the midsole toe cavity 124 and a heel comfort zone 134 is located within the midsole heel cavity 128. The anti-fatigue shoe apparatus 100 includes an insole 136 that has a top insole surface 138 oriented opposite a bottom insole surface 140. The bottom insole surface 140 is adhered to the top midsole surface 110 and the bottom midsole surface 112 is adhered to the top outsole surface 104.

In one embodiment, the outsole 102, shown in FIGS. 1-4, of the anti-fatigue shoe apparatus 100 is formed from a material selected from the group consisting of rubber, leather, and polyurethane.

In another embodiment, the midsole 108, shown in FIGS. 1-4, of the anti-fatigue shoe apparatus 100 is formed from a material selected from the group consisting of ethyl vinyl acetate, plastic, rubber, and polyurethane.

Figure 4:
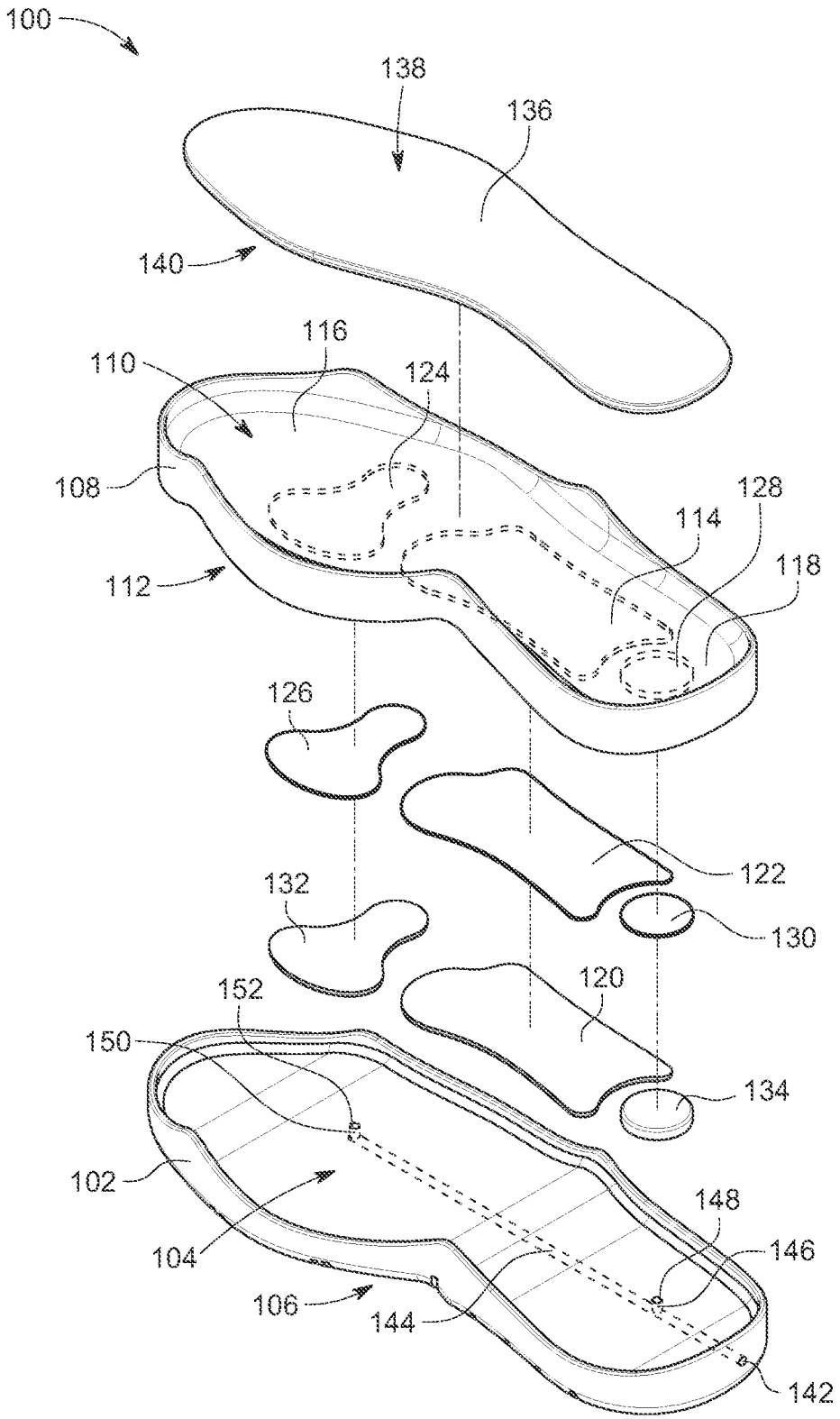
FIG. 4 is a top, rear, left side exploded perspective view of an anti-fatigue shoe apparatus, according to a preferred embodiment of the present invention.

In yet another embodiment, as illustrated in FIGS. 2-4, the raised arch shaped support piece 120 of the anti-fatigue shoe apparatus 100 is formed from a material selected from the group consisting of ethyl vinyl acetate, plastic, rubber, polyurethane foam, polyurethane gel, memory foam, vinyl, cork, and plastic.

In one embodiment, as shown in FIGS. 2-4, the midsole arch liner 122 of the anti-fatigue shoe apparatus 100 is formed from a material selected from the group consisting of rubber, leather, plastic, and polyurethane.

In another embodiment, as shown in FIGS. 2-4, the midsole toe liner 126 and the midsole heel liner 130 of the anti-fatigue shoe apparatus 100 are formed from a material selected from the group consisting of rubber, leather, plastic, and polyurethane.

In yet another embodiment, the midsole toe cavity 124 and the midsole heel cavity 128 are reinforced with a spray on material selected from the group consisting of polyurethane, polyamide, and polyacrylonitrile, and combinations thereof.

In one embodiment, illustrated in FIGS. 2-4, the toe comfort zone 132 and the heel comfort zone 134 of the anti-fatigue shoe apparatus 100 are formed from a material selected from the group consisting of rubber, polyurethane form, polyurethane gel, memory foam, vinyl, cork, and plastic.

Turning to FIG. 4, in another embodiment, the anti-fatigue shoe apparatus 100 further includes a tubular injection canal aperture 142 that is located in the outsole 102. The tubular injection canal aperture 142 leads to an outsole central injection canal 144. In accordance with the present embodiment, a heel comfort zone canal 146 rises vertically from the outsole central injection canal 144 and terminates within the midsole heel cavity 128 through a midsole heel cavity injection aperture 148. A toe comfort zone canal 150 also rises vertically from the outsole central injection canal 144 and terminates within the midsole toe cavity 124 through a midsole toe cavity injection aperture 152. In accordance with this embodiment of the anti-fatigue shoe apparatus 100, the outsole central injection canal 144, the heel comfort zone canal 146, and the toe comfort zone canal 150 are adapted to receive and retain the material that the toe comfort zone 132 and the heel comfort zone 134 are made out of in liquid form.

As illustrated in FIGS. 5-10, preferred embodiments of an anti-fatigue shoe apparatus 200 are provided for.

Figure 5:
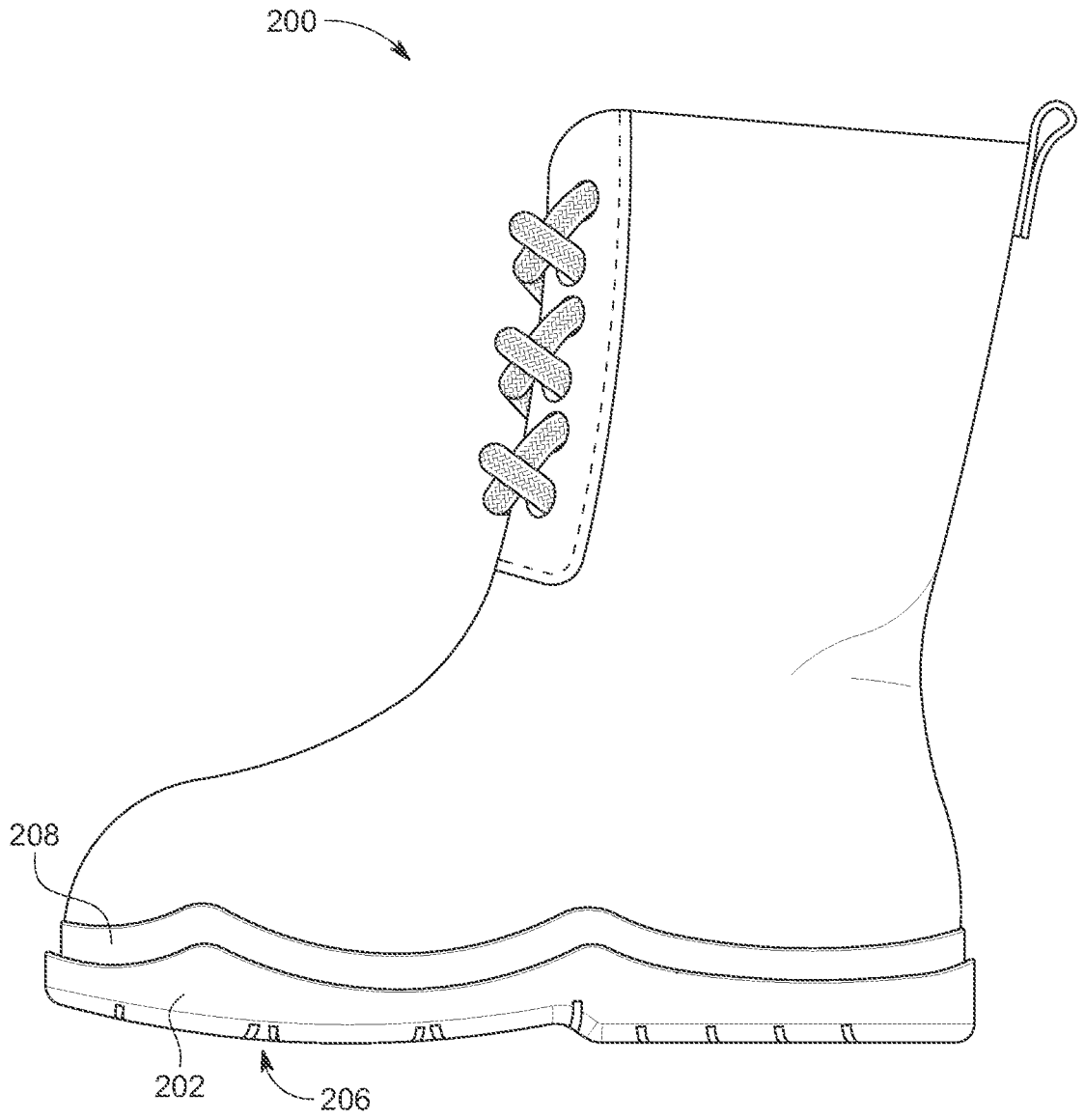
FIG. 5 is a right side elevation view of an anti-fatigue shoe apparatus within a work boot, according to a preferred embodiment of the present invention.
Figure 6:
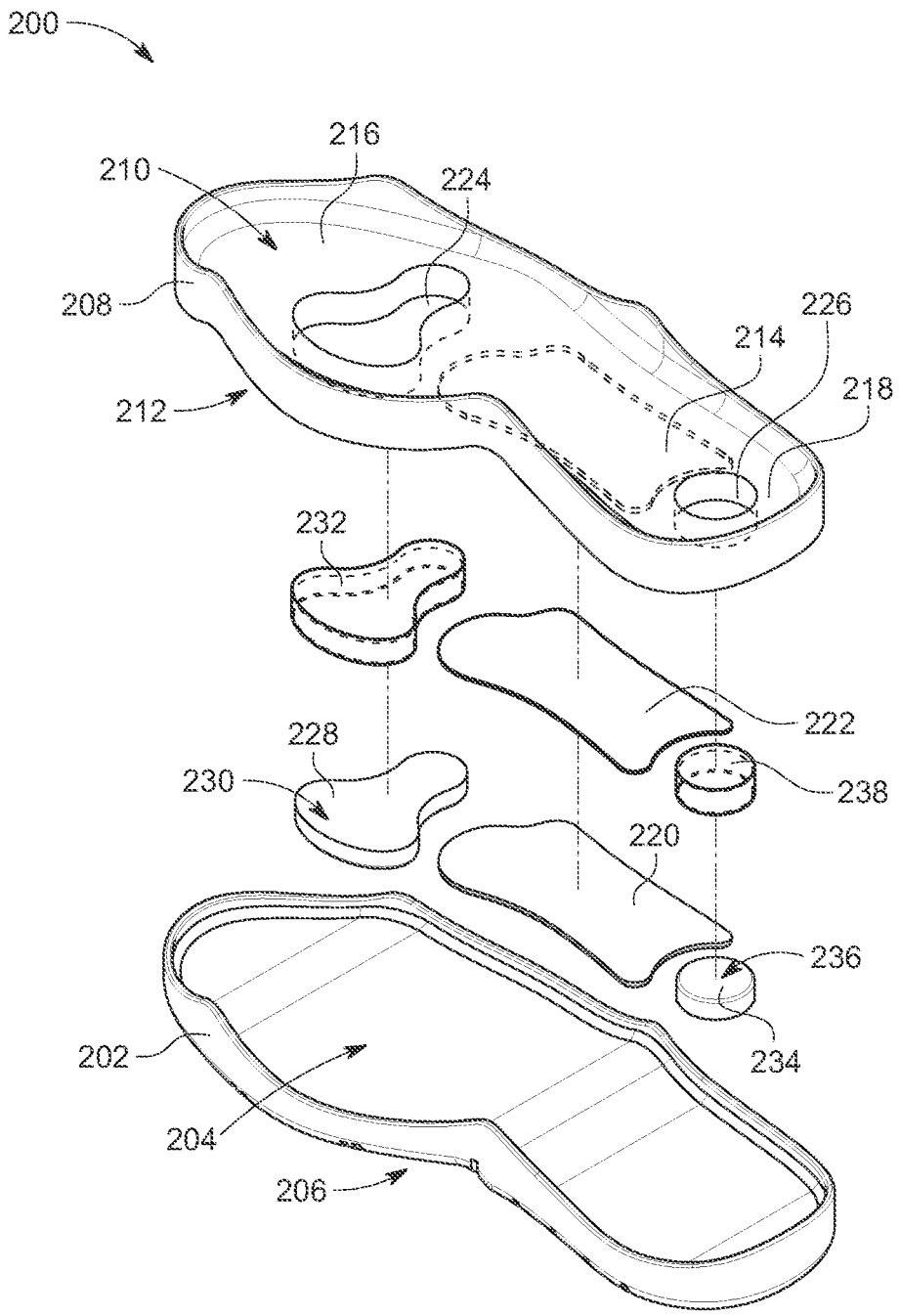
FIG. 6 is a top, rear, left side exploded perspective view of an anti-fatigue shoe apparatus, according to a preferred embodiment of the present invention.
Figure 7:
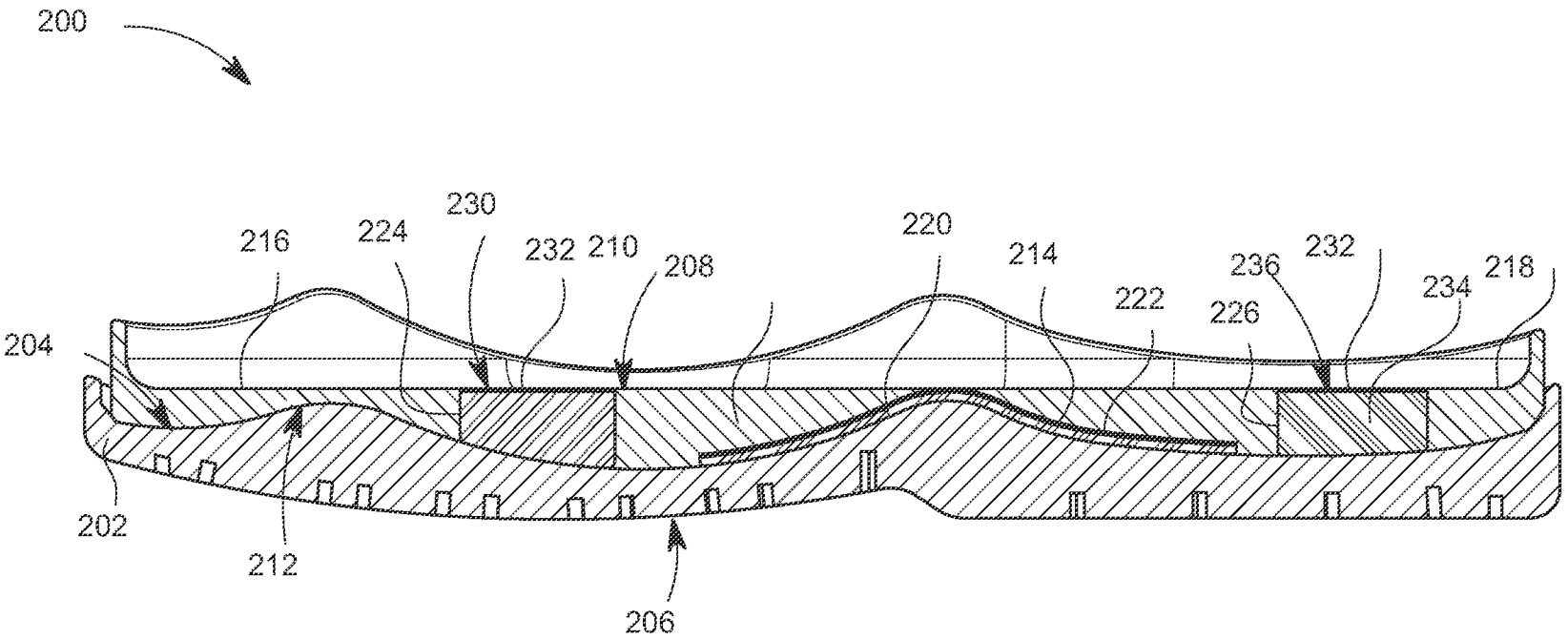
FIG. 7 is a right side cross-sectional elevation view thereof, according to preferred embodiments.

In such preferred embodiment of the invention, referring to FIGS. 5-7, the anti-fatigue shoe apparatus 200 includes an outsole 202 that has a top outsole surface 204 that is oriented opposite a bottom outsole surface 206. The bottom outsole surface 206 is designed to grip the ground. The anti-fatigue shoe apparatus 200 further includes a midsole 208 that is designed to reduce torque. As illustrated in FIGS. 6-7, the midsole 208 has a top midsole surface 210 that is oriented opposite a bottom midsole surface 212.

In accordance with the present invention, a midsole arch cavity 214 is formed centrally within the bottom midsole surface 212 of the midsole 208 and is located between a midsole toe section 216 that is oriented laterally opposite a midsole heel section 218, as shown in FIG. 6. A raised arch shaped support piece 220 is located within and adhered to the bottom midsole surface 212 of the midsole arch cavity 214. The raised arch shaped support piece 220 is designed to fit the natural curvature of a human foot.

The anti-fatigue shoe apparatus 200, as shown in FIGS. 6-9, includes a midsole arch liner 222 adhered to and located within the bottom midsole surface 212 of the midsole arch cavity 214. A midsole toe aperture 224 is formed in a substantially elliptical shape and oriented though the midsole toe section 216 and a midsole heel aperture 226 is formed in a substantially oval shape and oriented through the midsole heel section 218.

In accordance with the present invention, as shown in FIGS. 6-9, a toe comfort zone 228 is located within the midsole toe aperture 224 and surrounded by the top midsole surface 210. Furthermore, a top surface 236 of the toe comfort zone 228 is lined with a toe comfort zone fabric 232 that is designed for direct contact with a ball of the human foot. A heel comfort zone 234 is located within the midsole heel aperture 226 and is also surrounded by the top midsole surface 210. A top surface 236 of the heel comfort zone 234 is lined with a heel comfort zone fabric 238 that is designed for direct contact with a heel of the human foot and the bottom midsole surface 212 is adhered to the top outsole surface 204.

Figure 8:
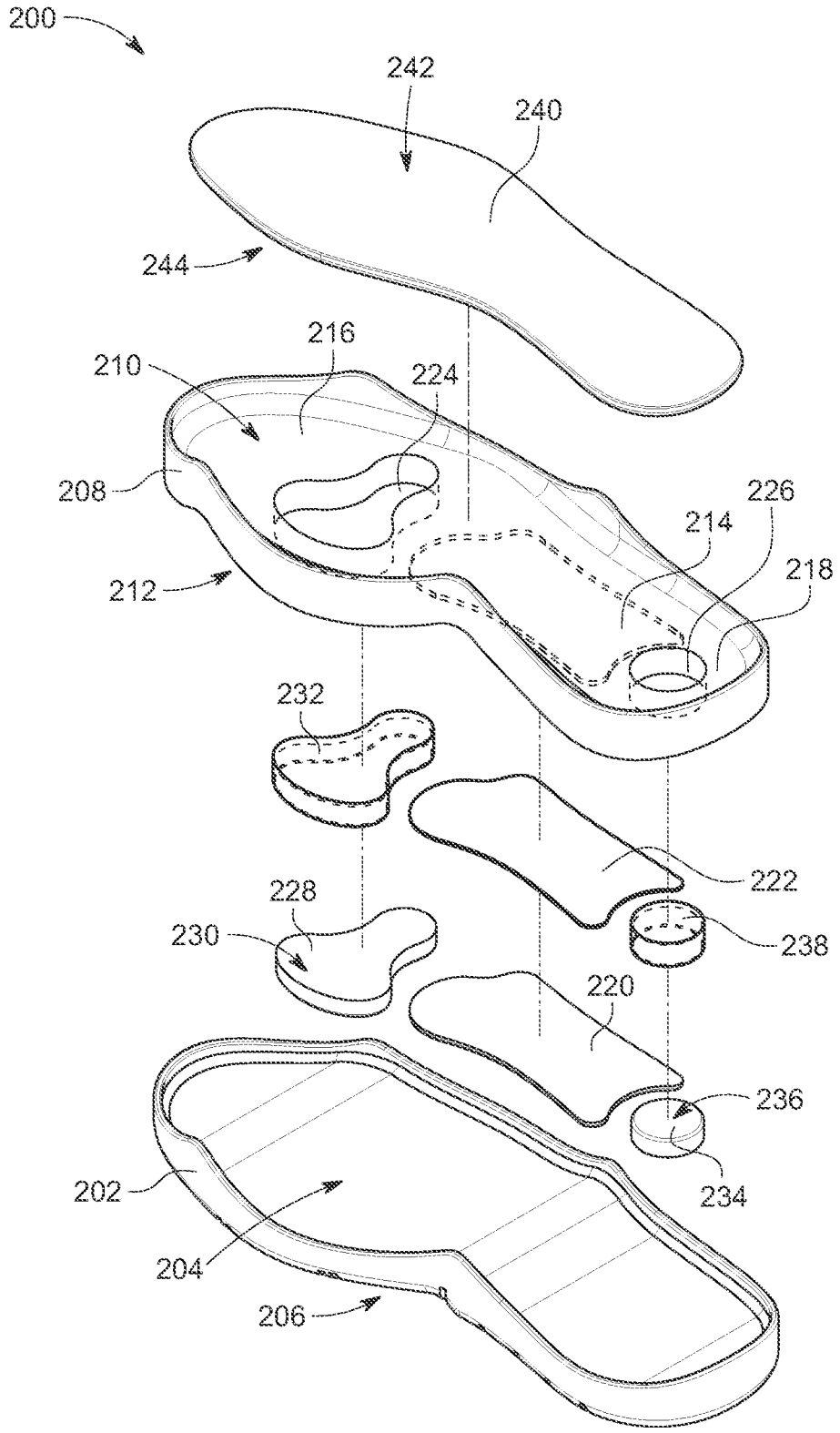
FIG. 8 is a top, rear, left side exploded perspective view thereof, with the insole option included, according to a preferred embodiment of the present invention.
Figure 9:
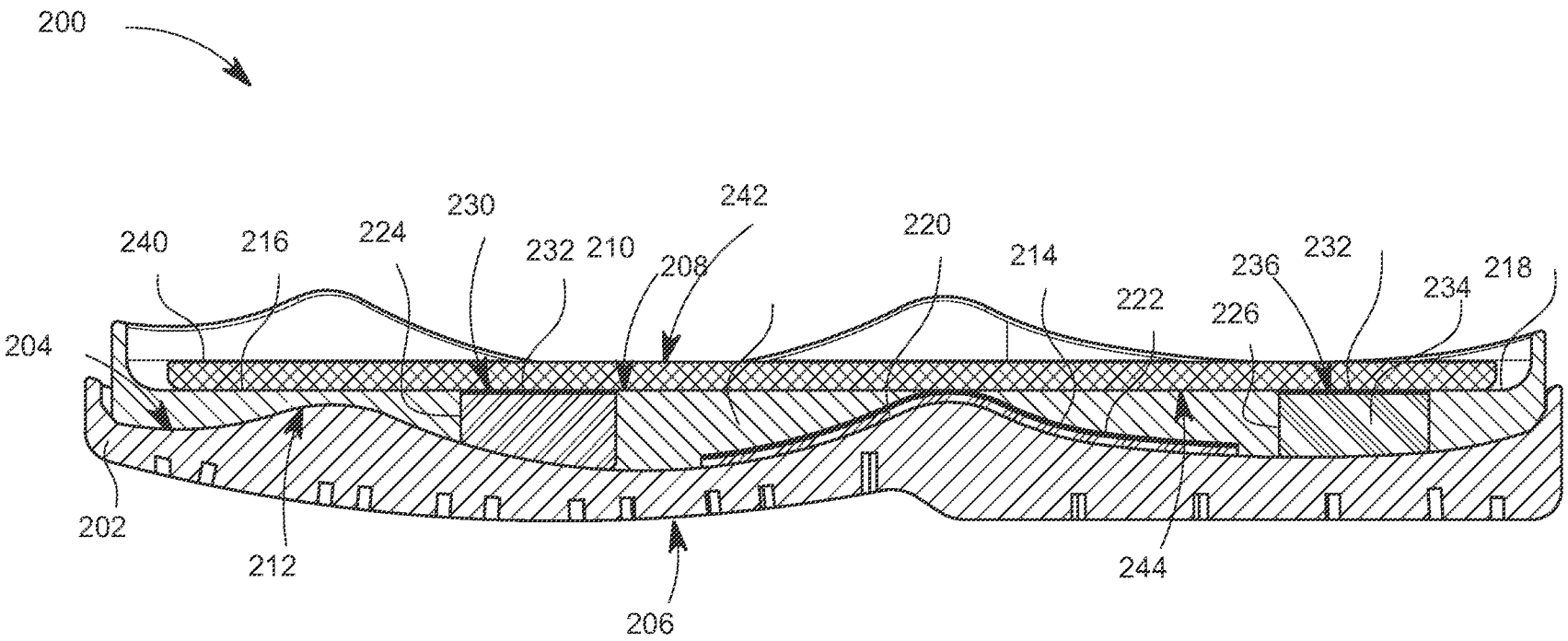
FIG. 9 is a right side cross-sectional elevation view thereof, according to preferred embodiments.

In one embodiment, turning to FIGS. 8 and 9, the anti-fatigue shoe apparatus 200 further includes an insole 240 having a top insole surface 242 oriented opposite a bottom insole surface 244. In such embodiment, the bottom insole surface 244 is adhered to the top midsole surface 210.

In another embodiment, the outsole 202, as shown in FIGS. 5-10, is formed from a material selected from the group consisting of rubber, leather, and polyurethane.

In yet another embodiment, as shown in FIGS. 5-10, the midsole 208 is formed from a material selected from the group consisting of ethyl vinyl acetate, plastic, rubber, and polyurethane.

In one embodiment, as illustrated in FIGS. 6-10, the raised arch shaped support piece 220 is formed from a material selected from the group consisting of ethyl vinyl acetate, plastic, rubber, polyurethane foam, polyurethane gel, memory foam, vinyl, cork, and plastic.

In another embodiment, shown in FIGS. 6-10, the midsole arch liner 222 is formed from as material selected from the group consisting of rubber, leather, plastic, and polyurethane.

In yet another embodiment, illustrated in FIGS. 6-10, the toe comfort zone fabric 232 and the heel comfort zone fabric 238 are formed from a material selected from the group consisting of petroleum, polyurethane, and leather, and combinations thereof.

In one embodiment, shown in FIGS. 6-10, the toe comfort zone 228 and the heel comfort zone 234 are formed from a material selected from the group consisting of rubber, polyurethane form, polyurethane gel, memory foam, vinyl, cork, and plastic.

Figure 10:
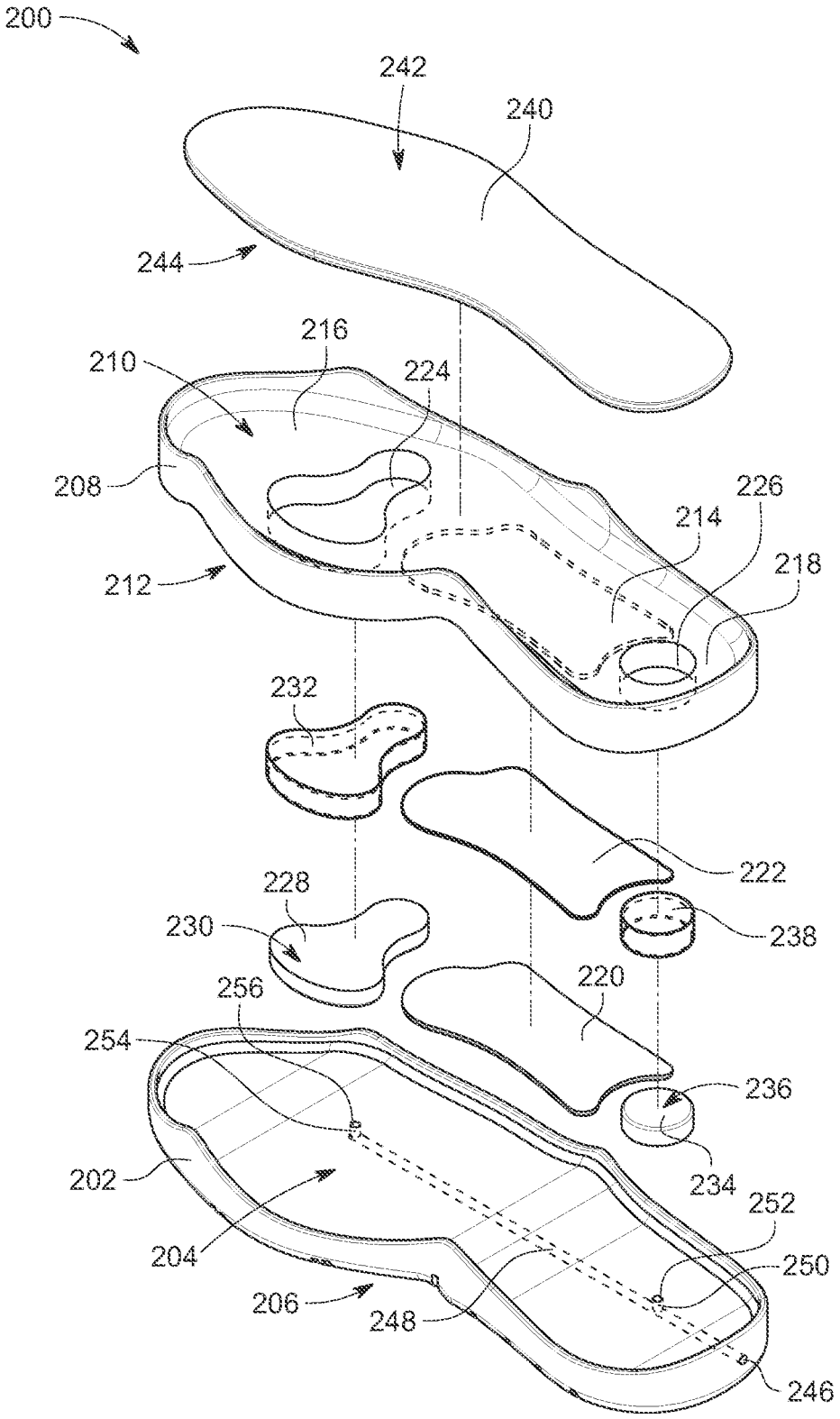
FIG. 10 is a top, rear, left side exploded perspective view thereof, with the insole option included and the injection canals for comfort zone materials, according to a preferred embodiment of the present invention.

Turning to FIG. 10, in another related embodiment, the anti-fatigue shoe apparatus 200 further includes a tubular injection canal aperture 246 located in the outsole 202. The tubular injection canal aperture 246 leads to an outsole central injection canal 248, where a heel comfort zone canal 250 rises vertically from the outsole central injection canal 248 and terminates within the midsole heel aperture 226 through a midsole heel injection aperture 252. In accordance with such embodiment of the invention, a toe comfort zone canal 254 rises vertically from the outsole central injection canal 248 and terminates within the midsole toe aperture 224 through a midsole toe injection aperture 256. The outsole central injection canal 248, the heel comfort zone canal 250, and the toe comfort zone canal 254 are designed to receive and retain the material of the toe comfort zone 228 and the heal comfort zone 234 in liquid form.

As illustrated in FIGS. 11-16, additional preferred embodiments of an anti-fatigue shoe apparatus 300 are provided for.

Figure 11:
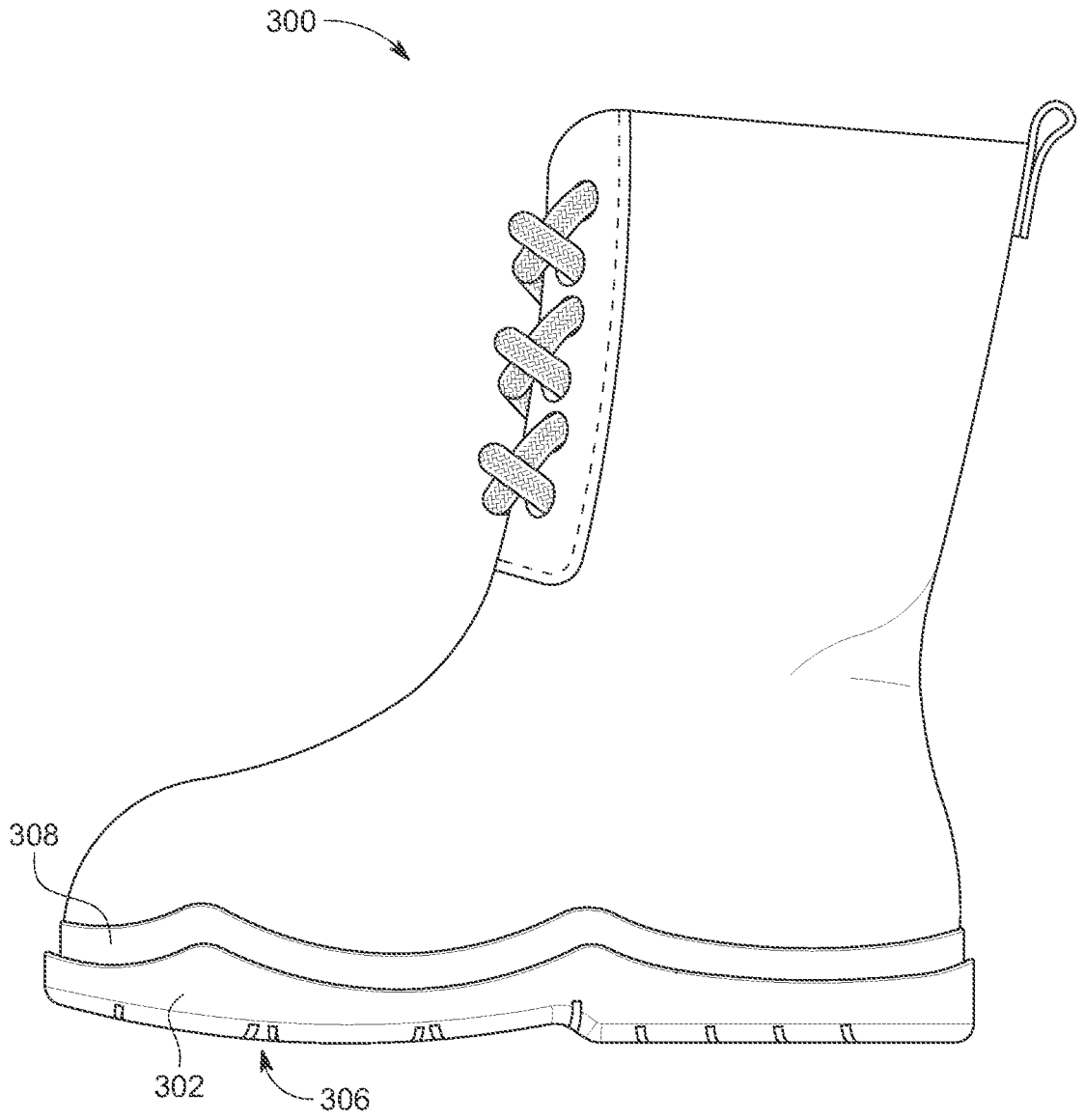
FIG. 11 is a right side elevation view of an anti-fatigue shoe apparatus within a work boot, according to a preferred embodiment of the present invention.
Figure 12:
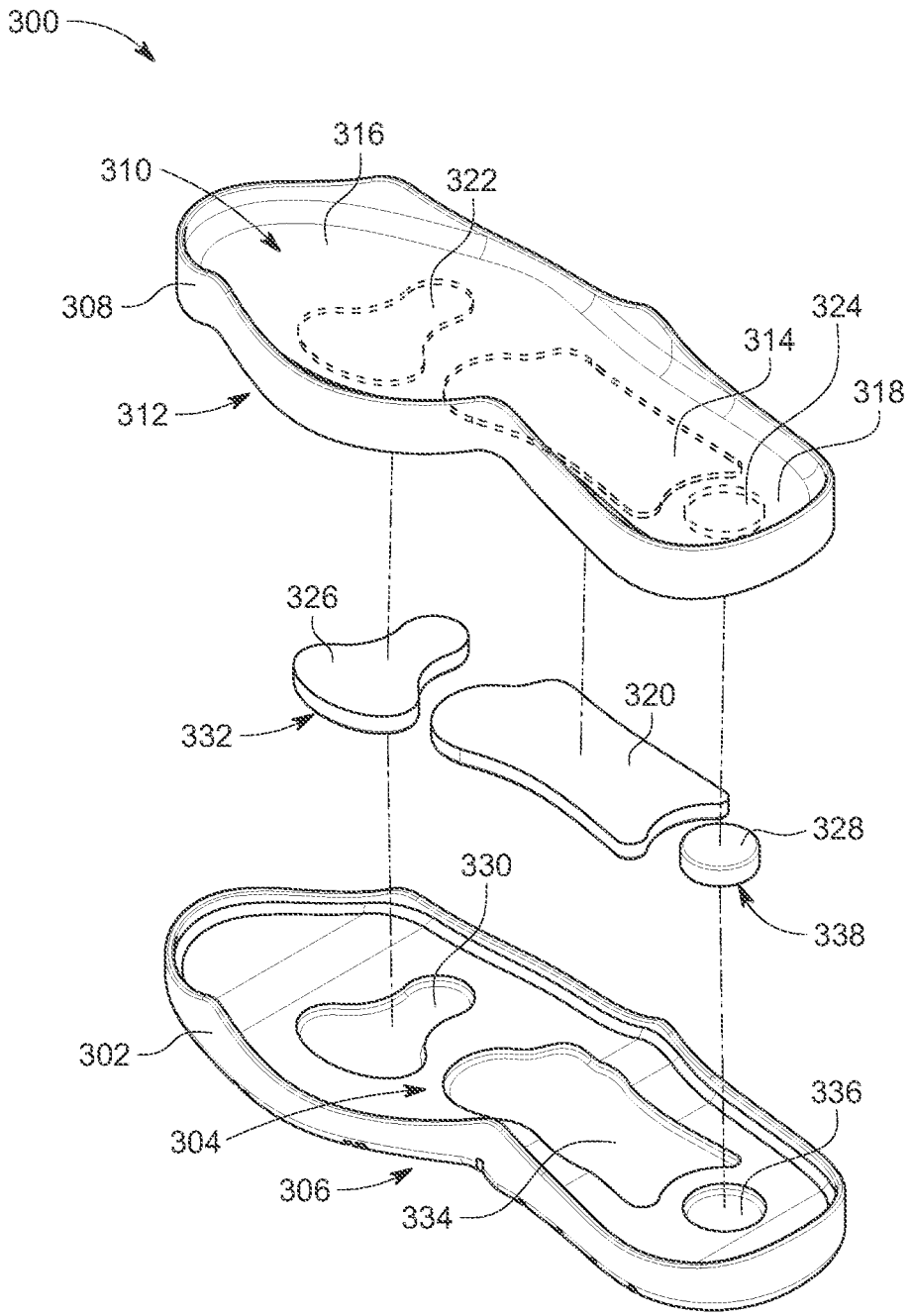
FIG. 12 is a top, rear, left side exploded perspective view of an anti-fatigue shoe apparatus, according to a preferred embodiment of the present invention.
Figure 13:
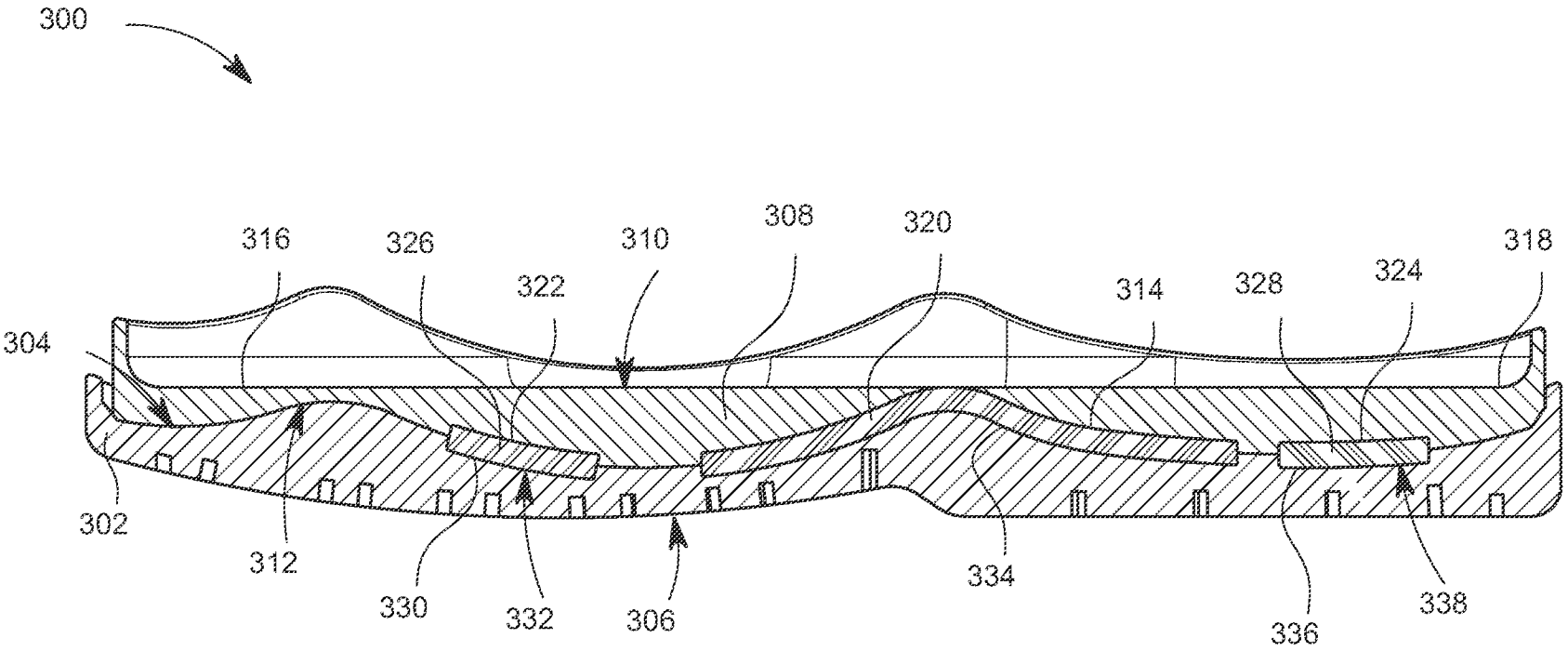
FIG. 13 is a right side cross-sectional elevation view thereof, according to preferred embodiments.

In such additional preferred embodiment of the invention, referring to FIGS. 11-13, the anti-fatigue shoe apparatus 300 includes an outsole 302 that has a top outsole surface 304 oriented opposite a bottom outsole surface 306. The bottom outsole surface 306 is designed to grip the ground and a midsole 308 is designed to reduce torque. As shown in FIGS. 12-15, the midsole 308 has a top midsole surface 310 oriented opposite a bottom midsole surface 312. A midsole arch cavity 314 is formed centrally within the bottom midsole surface 312 of the midsole 308 and located between a midsole toe section 316 that is oriented laterally opposite a midsole heel section 318.

In accordance with the present invention, shown in FIGS. 12-16, the anti-fatigue shoe apparatus 300 includes a raised arch shaped support piece 320 located within and adhered to the bottom midsole surface 312 of the midsole arch cavity 314, and the raised arch shaped support piece 320 is designed to receive the shape of the natural curvature of the arch of a human foot. Furthermore, a midsole toe cavity 322 is formed in a substantially elliptical shape and located within the bottom midsole surface 312 of the midsole toe section 316. A midsole heel cavity 324 is formed in a substantially oval shape and located within the bottom midsole surface 312 of the midsole heel section 318. The anti-fatigue shoe apparatus 300 includes an extruding toe comfort zone 326 that is adhered to and located within the midsole toe cavity 322 and an extruding heel comfort zone 328 that is adhered to and located within the midsole heel cavity 324.

Continuing to refer to FIGS. 12-16, in accordance with the present invention, the anti-fatigue shoe apparatus 300 also includes an outsole toe cavity 330 that is formed in a substantially elliptical shape and is located within the top outsole surface 304. The outsole toe cavity 330 is designed to receive a bottom surface 338 of the extruding toe comfort zone 326 and is aligned with the midsole toe section 316. An outsole arch cavity 334 is formed centrally within the top outsole surface 304 of the outsole 302, and the outsole arch cavity 334 is designed to receive and retain the raised arch shaped support 320.

In accordance with the present invention, shown in FIGS. 12-16, the anti-fatigue shoe apparatus 300 also includes an outsole heel cavity 336 that is formed in a substantially oval shape and oriented within the top outsole surface 304. The outsole heel cavity 336 is designed to receive a bottom surface 338 of the extruding heel comfort zone 328 and is aligned with the midsole heel section 318. The bottom midsole surface 312 is adhered to the top outsole surface 304.

Figure 14:
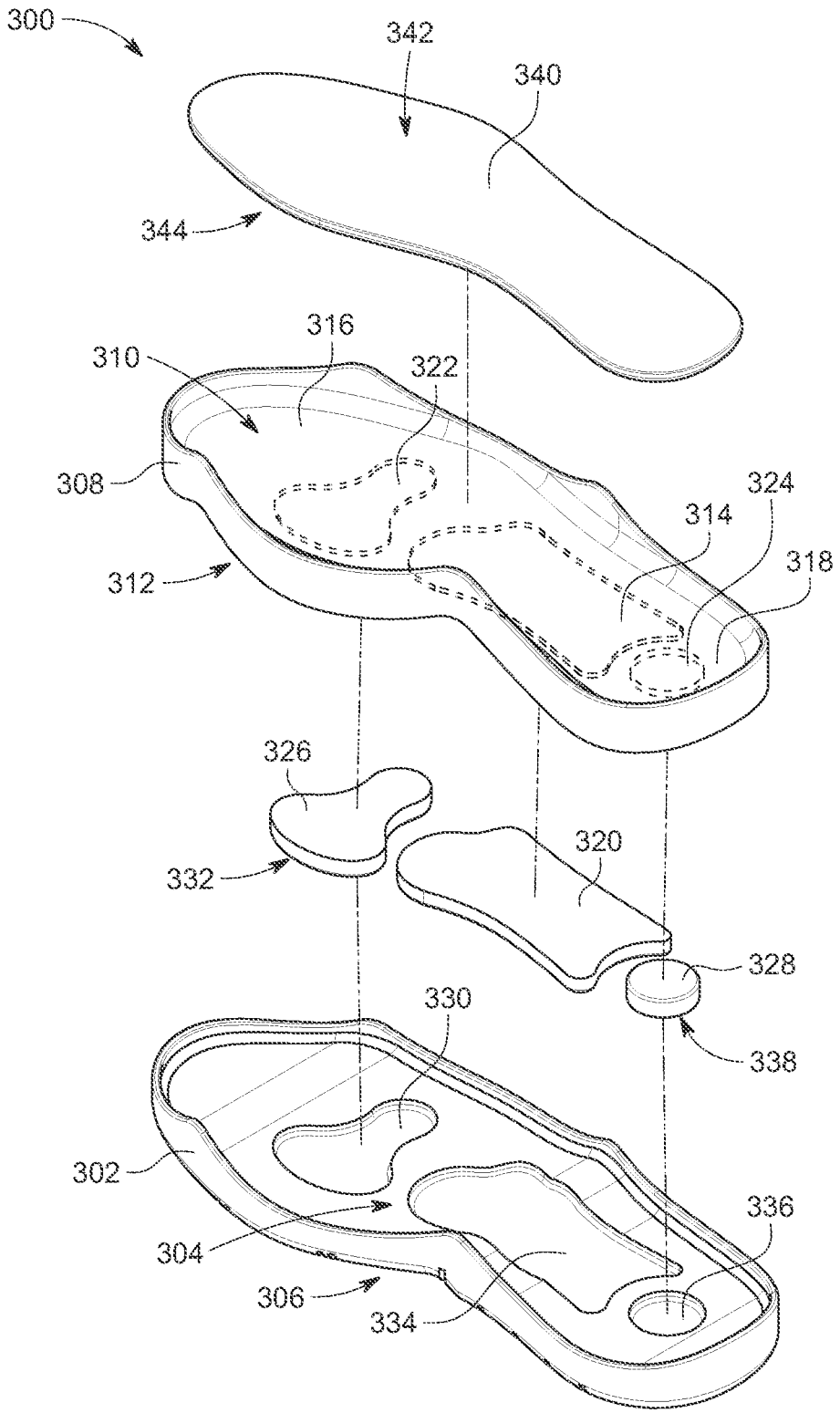
FIG. 14 is a top, rear, left side exploded perspective view thereof, with the insole option included and the injection canals for comfort zone materials, according to a preferred embodiment of the present invention.
Figure 15:
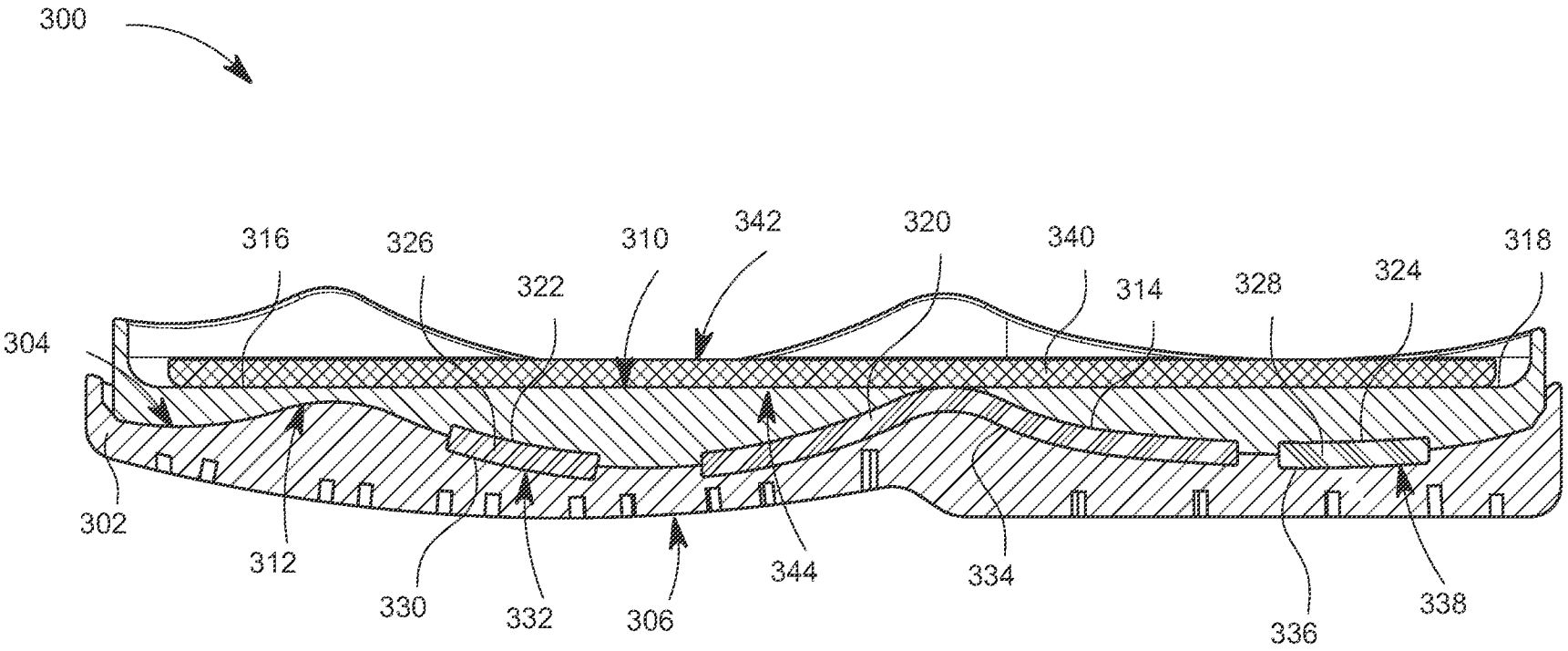
FIG. 15 is a right side cross-sectional elevation view thereof, according to preferred embodiments.
Figure 16:
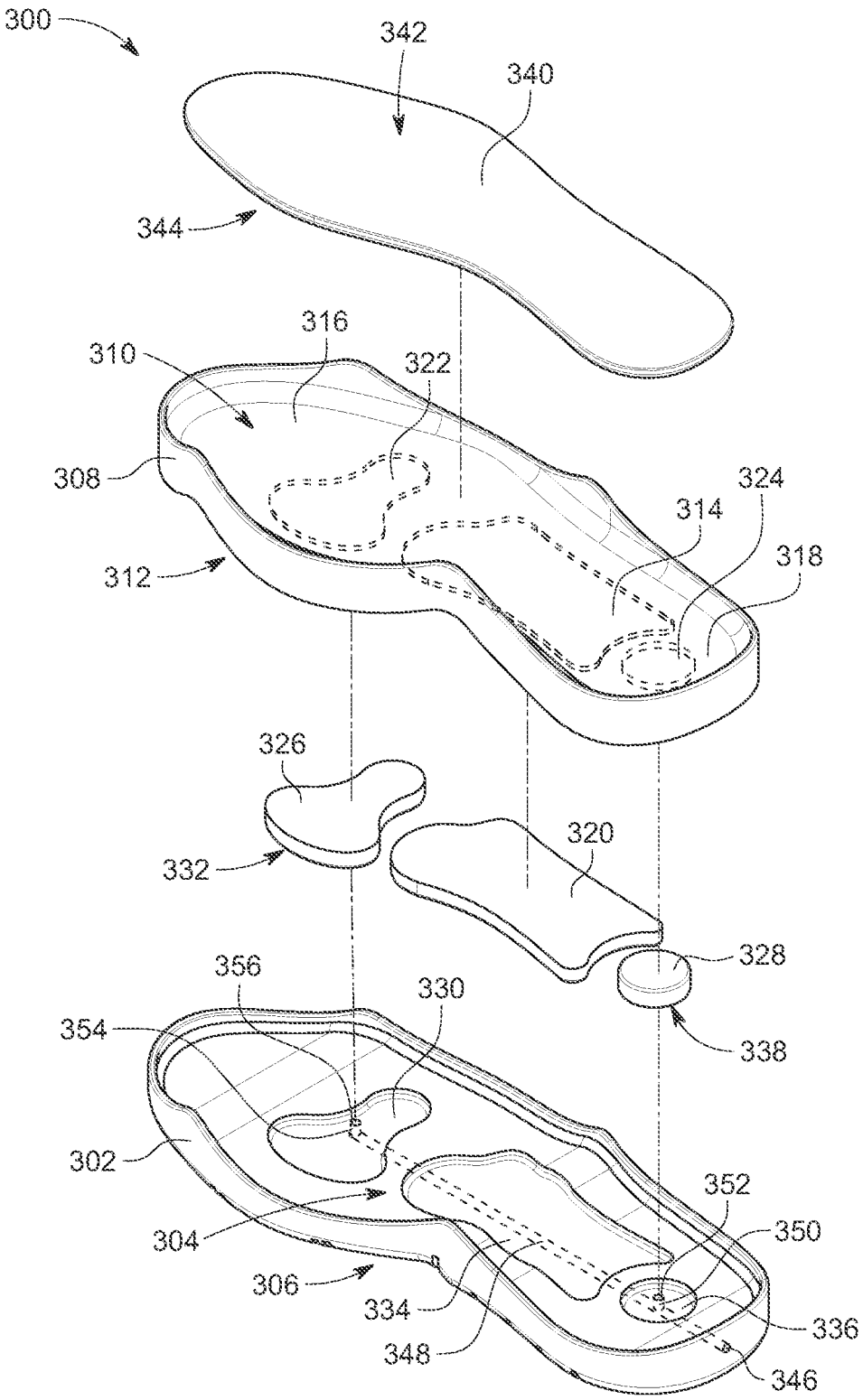
FIG. 16 is a top, rear, left side exploded perspective view thereof, with the insole option included and the injection canals for comfort zone materials, according to a preferred embodiment of the present invention.

In one embodiment, reflected in FIGS. 14-16, the anti-fatigue shoe apparatus 300 further includes an insole 340 that has a top insole surface 342 oriented opposite a bottom insole surface 344 and the bottom insole surface 344 is adhered to the top midsole surface 310.

In another embodiment, shown in FIGS. 11-16, the outsole 302 is formed from a material selected from the group consisting of rubber, leather, and polyurethane.

In yet another embodiment, as reflected in FIGS. 11-16, the midsole 308 is formed from a material selected from the group consisting of ethyl vinyl acetate, plastic, rubber, and polyurethane.

In one embodiment, illustrated in FIGS. 12-16, the raised arch shaped support piece 320 is formed from a material selected from the group consisting of ethyl vinyl acetate, plastic, rubber, polyurethane foam, polyurethane gel, memory foam, vinyl, cork, and plastic.

In another embodiment, as reflected in FIGS. 12-16, the midsole toe cavity 322, the midsole heel cavity 324, the outsole toe cavity 330, and the outsole heel cavity 336 are reinforced with a spray on material selected from the group consisting of polyurethane, polyamide, and polyacrylonitrile, and combinations thereof.

In yet another embodiment, the extruding toe comfort zone 326 and the extruding heel comfort zone 328, such as those in FIGS. 12-16, are formed from a material selected from the group consisting of rubber, polyurethane form, polyurethane gel, memory foam, vinyl, cork, and plastic.

Turning to FIG. 16, in another related embodiment, the anti-fatigue shoe apparatus 300 further includes a tubular injection canal aperture 346 located in the outsole 302. The tubular injection canal aperture 346 opens to a central injection canal 348. An outsole heel injection canal 350 rises vertically from the central injection canal 348 and terminates within the outsole heel cavity 336 through a heel cavity injection aperture 352.

In accordance with such embodiment of the invention, as illustrated in FIG. 16, an outsole toe injection canal 354 rises vertically from the central injection canal 348 and terminates within the outsole toe cavity 330 through an outsole toe cavity injection aperture 356. The central injection canal 348 is designed to be substantially U-shaped and located below the outsole arch cavity 334. The outsole heel injection canal 350, the central injection canal 348, and the outsole toe injection canal 354 is designed to receive and retain the material of the extruding toe comfort zone 326 and the extruding heel comfort zone 328 in liquid form.

As illustrated in FIGS. 17-20, another additional preferred embodiment of an anti-fatigue shoe apparatus 400 is provided.

Figure 17:
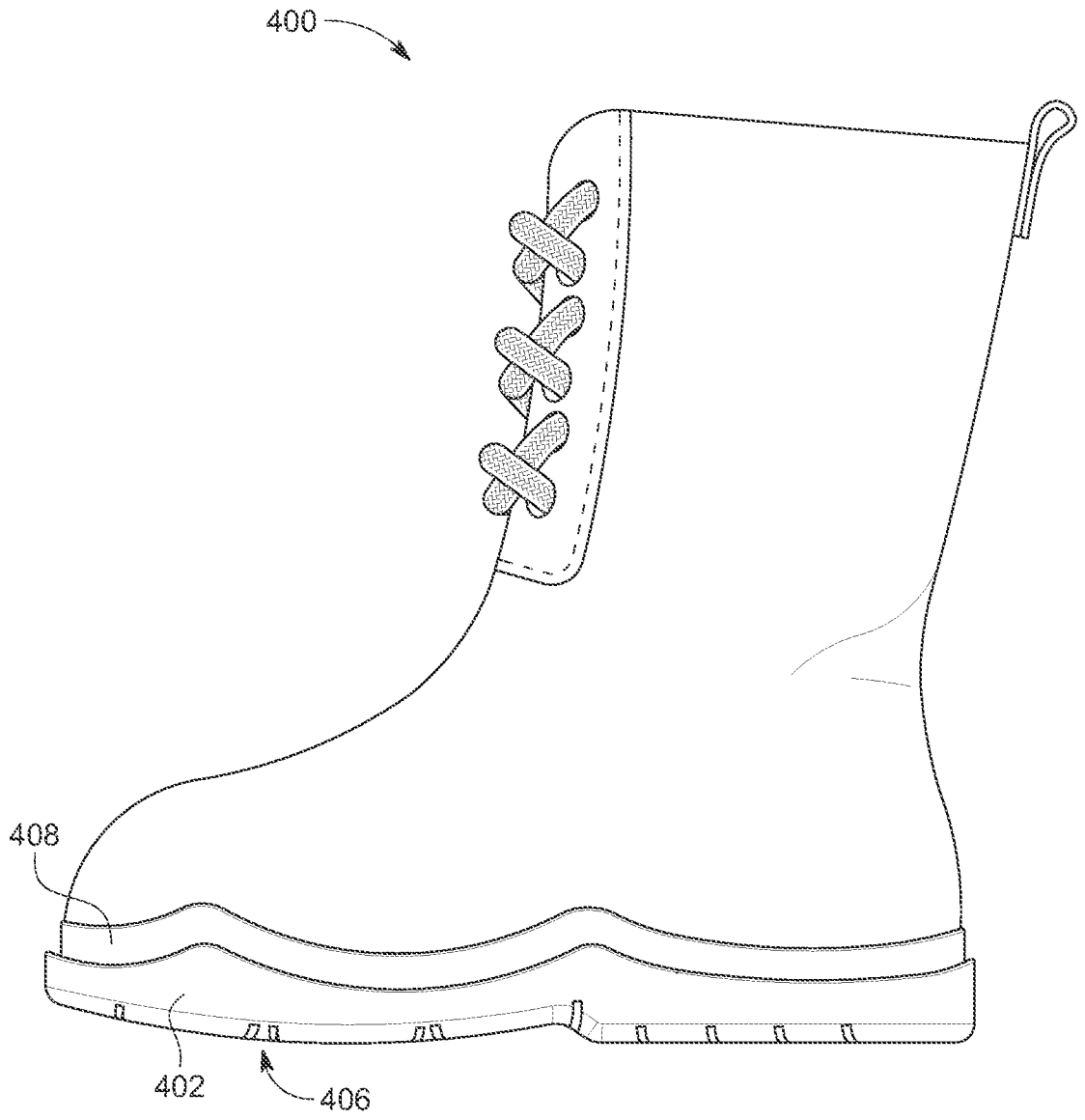
FIG. 17 is a right side elevation view of an anti-fatigue shoe apparatus within a work boot, according to a preferred embodiment of the present invention.
Figure 18:
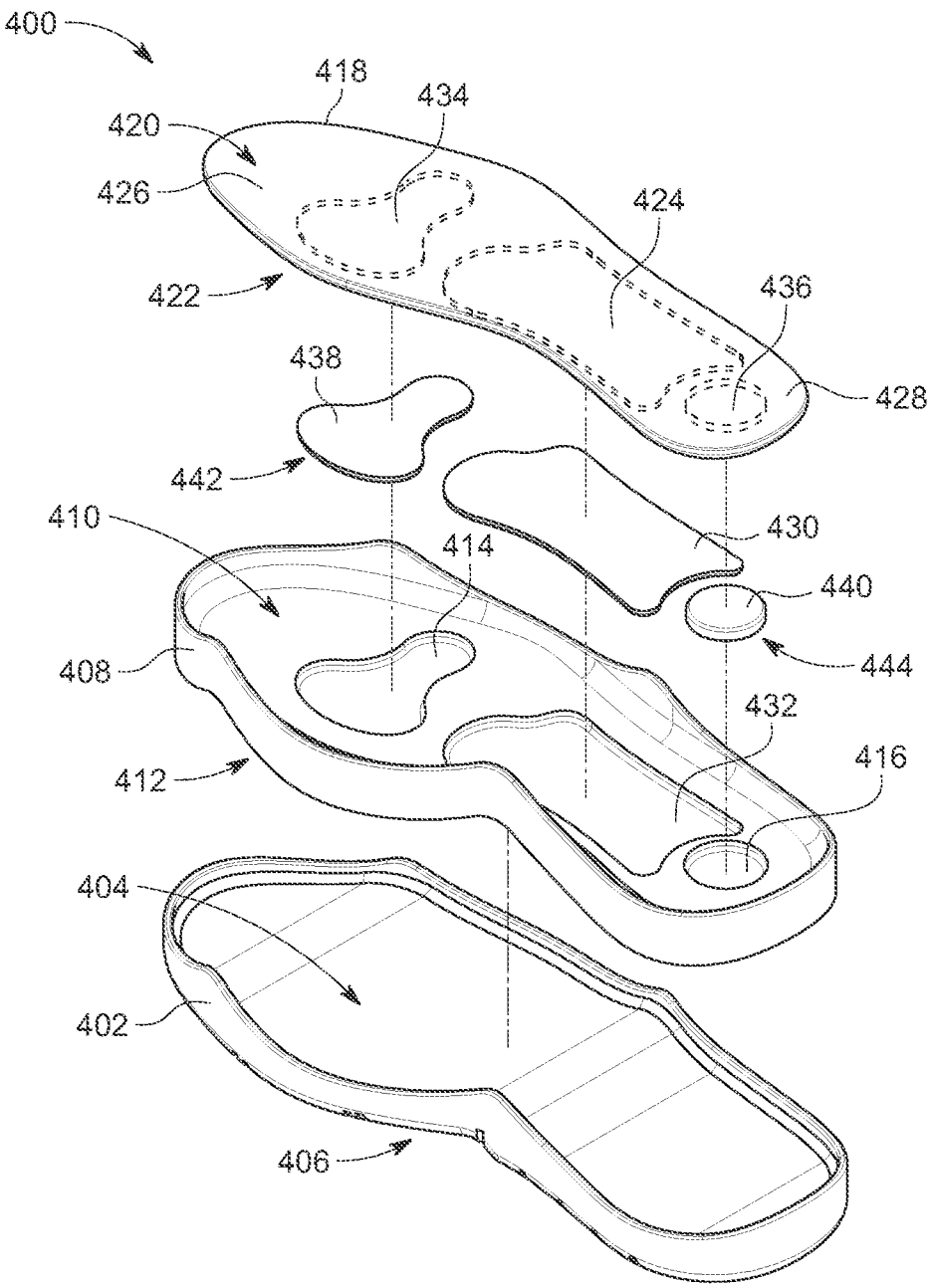
FIG. 18 is a top, rear, left side exploded perspective view of an anti-fatigue shoe apparatus, according to a preferred embodiment of the present invention.
Figure 19:
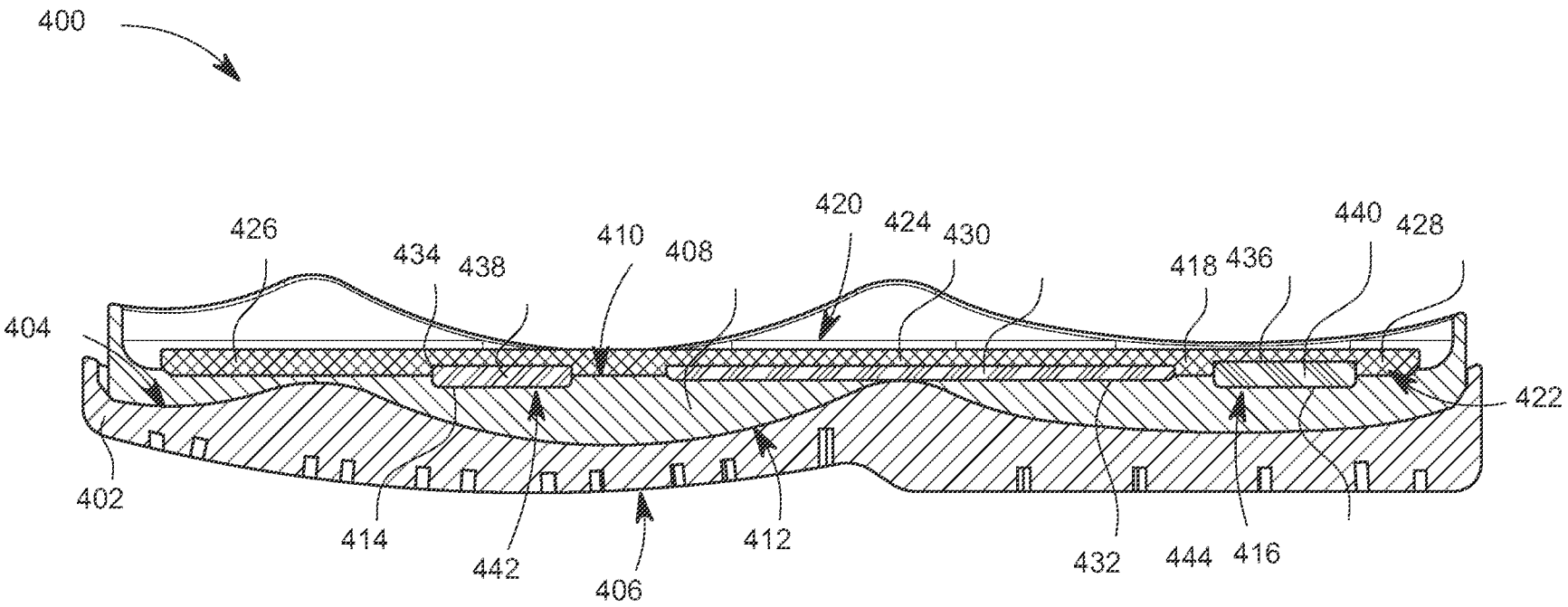
FIG. 19 is a right side cross-sectional elevation view thereof, according to preferred embodiments.
Figure 20:
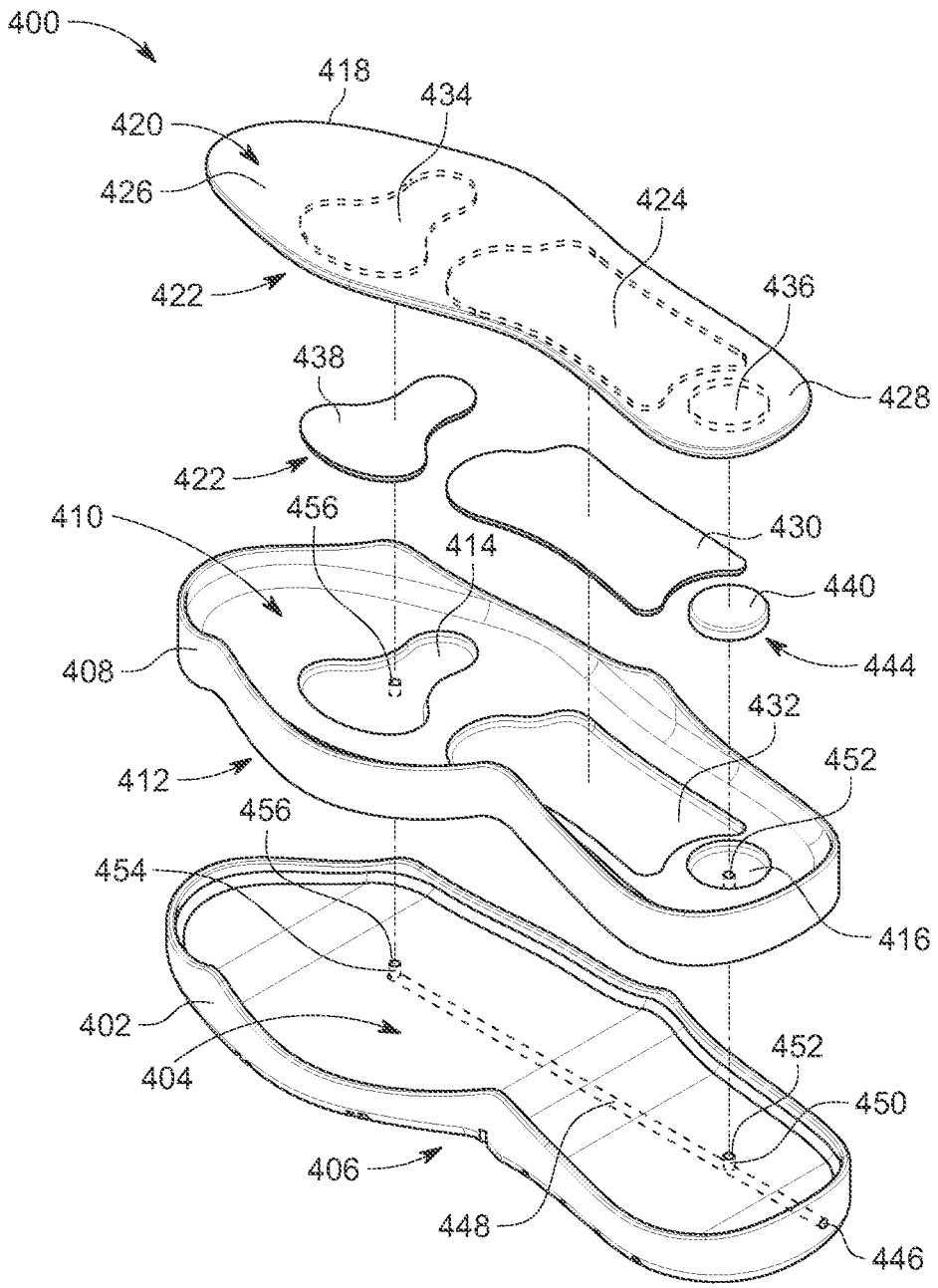
FIG. 20 is a top, rear, left side exploded perspective view thereof, with the injection canals for comfort zone materials, according to a preferred embodiment of the present invention.

In such additional preferred embodiment of the invention, referring to FIGS. 17-19, the anti-fatigue shoe apparatus 400 includes an outsole 402 that has a top outsole surface 404 oriented opposite a bottom outsole surface 406. The bottom outsole surface 406 is designed to grip the ground. The anti-fatigue shoe apparatus 400 also includes a midsole 408 that has a top midsole surface 410 oriented opposite a bottom midsole surface 412. As illustrated in FIGS. 18-20, the top midsole surface 410 includes a midsole toe cavity 414 that is oriented laterally opposite from a midsole heel cavity 416. The midsole toe cavity 414 is formed in a substantially elliptical shape and located within the top midsole surface 410, where the midsole heel cavity 416 is formed in a substantially oval shape and is located within the top midsole surface 410.

Continuing to refer to FIGS. 18-20, in accordance with the present invention, the anti-fatigue shoe apparatus 400 includes an insole 418 that has a top insole surface 420 oriented opposite a bottom insole surface 422. An insole arch cavity 424 is formed centrally within the bottom insole surface 422 and the insole arch cavity 424 is located between an insole toe section 426 of the bottom insole surface 422 which is oriented laterally opposite from an insole heel section 428 of the bottom insole surface 422.

The anti-fatigue shoe apparatus 400, referring to FIGS. 18-20, includes a raised arch shaped support piece 430 located within and adhered to the bottom insole surface 422 of the insole arch cavity 424. A midsole arch cavity 432 is centrally formed within the top midsole surface 410 and the midsole arch cavity 432 is located between the midsole toe cavity 414 and the midsole heel cavity 416. The midsole arch cavity 432 is formed to retain the raised arch shaped support piece 430. The raised arch shaped support piece 430 is designed to receive the shape of a natural curvature of the arch of a human foot.

Continuing to refer to FIGS. 18-20, in accordance with the present invention, an insole toe cavity 434 is formed in a substantially elliptical shape and located within the bottom insole surface 422 of the insole toe section 426. Included is an insole heel cavity 436 that is formed in a substantially oval shape and located within the bottom insole surface 422 of the insole heel section 428. An extruding toe comfort zone 438 is adhered to and located within the insole toe cavity 434 and an extruding heel comfort zone 440 is adhered to and located within the insole heel cavity 436.

The midsole toe cavity 414 is designed to receive a bottom surface 442 of the extruding toe comfort zone 438, and the midsole heel cavity 416 is designed to receive a bottom surface 444 of the extruding heel comfort zone 440. The bottom insole surface 422 is adhered to the bottom midsole surface 412 and the bottom midsole surface 412 is adhered to the top outsole surface 404.

In one embodiment, as illustrated in FIGS. 17-20, the outsole 402 is formed from a material selected from the group consisting of rubber, leather, and polyurethane.

In another embodiment, as shown in FIGS. 17-20, the midsole 408 is formed from a material selected from the group consisting of ethyl vinyl acetate, plastic, rubber, and polyurethane.

In yet another embodiment, as reflected in FIGS. 18-20, the insole 418 is formed from a material selected from the group consisting of ethyl vinyl acetate, plastic, rubber, and polyurethane.

Continuing to refer to FIGS. 18-20, in one embodiment, the raised arch shaped support piece 430 is formed from a material selected from the group consisting of ethyl vinyl acetate, plastic, rubber, polyurethane foam, polyurethane gel, memory foam, vinyl, cork, and plastic.

In another embodiment, referring to FIGS. 18-20, the insole toe cavity 434, the insole heel cavity 436, the midsole toe cavity 414, and the midsole heel cavity 416 are reinforced with a spray on material selected from the group consisting of polyurethane, polyamide, and polyacrylonitrile, and combinations thereof.

In yet another embodiment, continuing to refer to FIGS. 18-20, the extruding toe comfort zone 438 and the extruding heel comfort zone 440 are formed from a material selected from the group consisting of rubber, polyurethane foam, polyurethane gel, memory foam, vinyl, cork, and plastic.

Turning to FIG. 20, in another related embodiment, the anti-fatigue shoe apparatus 400 further includes a tubular injection canal aperture 446 located in the outsole 402. The tubular injection canal aperture 446 leads to an outsole central injection canal 448 and a heel comfort zone canal 450 rises vertically from the outsole central injection canal 448 that terminates within the midsole heel cavity 416 through a midsole heel cavity injection aperture 452. A toe comfort zone canal 454 rises vertically from the outsole central injection canal 448 and terminates within the midsole toe cavity 414 through a midsole toe cavity injection aperture 456.

In accordance with such embodiment, continuing to refer to FIG. 20, the outsole central injection canal 448, the heel comfort zone canal 450, and the toe comfort zone canal 454 are designed to receive and retain the material of the extruding toe comfort zone 438 and the extruding heal comfort zone 440 in liquid form.

It will be apparent to persons skilled in the relevant art that various changes in form and detail can be made without departing from the spirit and scope of the invention. While various embodiments of the present invention have been described above, it should be understood that they have been presented by way of example only, and not limitation. Thus, the breadth and scope of the present invention should not be limited by any of the above-described exemplary embodiments, but should only be defined in accordance with the following claims and their equivalents. All patents and publications discussed herein are incorporated in their entirety by reference thereto.

The claimed invention is:

1. An anti-fatigue shoe apparatus, comprising:

an outsole comprising a top outsole surface opposite a bottom outsole surface;

wherein said bottom outsole surface adapted to grip the ground;

a midsole adapted to reduce torque comprising a top midsole surface opposite a bottom midsole surface;

a midsole arch cavity centrally formed within the bottom midsole surface of the midsole and disposed between a midsole toe section laterally opposite a midsole heel section;

a raised arch shaped support piece disposed within and adhered to the bottom midsole surface of said midsole arch cavity, wherein said raised arch shaped support piece adapted for a natural curvature of a human foot;

a midsole arch liner adhered to and disposed within the bottom midsole surface of said midsole arch cavity;

a midsole toe aperture formed in a substantially elliptical shape and disposed though the midsole toe section and a midsole heel aperture formed in a substantially oval shape and disposed through the midsole heel section;

a toe comfort zone disposed within the midsole toe aperture surrounded by said top midsole surface, wherein a top surface of the toe comfort zone lined with a toe comfort zone fabric adapted for direct contact with a ball of the human foot;

a heel comfort zone disposed within the midsole heel aperture surrounded by said top midsole surface, wherein a top surface of the heel comfort zone lined with a heel comfort zone fabric adapted for direct contact with a heel of the human foot; and said bottom midsole surface adhered to said top outsole surface.

2. The apparatus of claim 1, further comprising an insole comprising a top insole surface opposite a bottom insole surface, said bottom insole surface adhered to the top midsole surface.

3. The apparatus of claim 1, wherein the outsole is formed from a material selected from the group consisting of rubber, leather, and polyurethane.

4. The apparatus of claim 1, wherein the midsole is formed from a material selected from the group consisting of ethyl vinyl acetate, plastic, rubber, and polyurethane.

5. The apparatus of claim 1, wherein the raised arch shaped support piece is formed from a material selected from the group consisting of ethyl vinyl acetate, plastic, rubber, polyurethane foam, polyurethane gel, memory foam, vinyl, cork, and plastic.

6. The apparatus of claim 1, wherein the midsole arch liner is formed from a material selected from the group consisting of rubber, leather, plastic, and polyurethane.

7. The apparatus of claim 1, wherein said toe comfort zone fabric and said heel comfort zone fabric are formed from a material selected from the group consisting of petroleum, polyurethane, and leather, and combinations thereof.

8. The apparatus of claim 1, wherein the toe comfort zone and the heel comfort zone are formed from a material selected from the group consisting of rubber, polyurethane foam, polyurethane gel, memory foam, vinyl, cork, and plastic.

9. The apparatus of claim 8, further comprising a tubular injection canal aperture disposed in the outsole, said tubular injection canal aperture leading to an outsole central injection canal;

a heel comfort zone canal rising vertically from said outsole central injection canal terminating within the midsole heel aperture through a midsole heel injection aperture and a toe comfort zone canal rising vertically from said outsole central injection canal terminating within the midsole toe aperture through a midsole toe injection aperture, wherein said outsole central injection canal, said heel comfort zone canal, and said toe comfort zone canal adapted to receive and retain the material of the toe comfort zone and the heel comfort zone in liquid form.

* * * * *